US008511595B2

(12) United States Patent
Lindroos et al.

(10) Patent No.: US 8,511,595 B2
(45) Date of Patent: Aug. 20, 2013

(54) REFINER AND METHOD FOR REFINING FIBROUS MATERIAL

(75) Inventors: Kati Lindroos, Lempäälä (FI); Jorma Halla, Valkeakoski (FI); Markku Partanen, Valkeakoski (FI); Kauko Vänni, Nokia (FI)

(73) Assignee: Metso Paper, Inc., Helsinki (FI)

( * ) Notice: Subject to any disclaimer, the term of this patent is extended or adjusted under 35 U.S.C. 154(b) by 286 days.

(21) Appl. No.: 12/999,990

(22) PCT Filed: Jun. 18, 2009

(86) PCT No.: PCT/FI2009/050545

§ 371 (c)(1),
(2), (4) Date: Jan. 6, 2011

(87) PCT Pub. No.: WO2009/153412

PCT Pub. Date: Dec. 23, 2009

(65) Prior Publication Data

US 2011/0089273 A1 Apr. 21, 2011

(30) Foreign Application Priority Data

Jun. 19, 2008 (FI) ..... 20080414

(51) Int. Cl.
*B02C 17/00* (2006.01)
*B02C 17/02* (2006.01)
*B02C 13/00* (2006.01)

(52) U.S. Cl.
USPC ..... 241/84; 241/86; 241/89.3

(58) Field of Classification Search
USPC ..... 241/83–89.4, 261.1, 261.2, 261.3, 241/297, 298, 30, 293
See application file for complete search history.

(56) References Cited

U.S. PATENT DOCUMENTS 2,741,954 A 4/1956 Allibe
4,819,881 A 4/1989 Sepke

FOREIGN PATENT DOCUMENTS

DE 102004039986 A1 * 12/2007
WO 9218691 A1 10/1992
WO 2009153412 A1 12/2009
WO 2009153413 A1 12/2009

OTHER PUBLICATIONS

International Search Report for PCT/FI2009/050545.
Written Opinion of the International Searching Authority for PCT/FI2009/050545.

* cited by examiner

*Primary Examiner* — Dana Ross
*Assistant Examiner* — Chwen-Wei Su
(74) *Attorney, Agent, or Firm* — Stiennon & Stiennon

(57) ABSTRACT

A refiner (1, 18, 19) for refining fibrous material has at least one first refining surface (11) and at least one second refining surface (4), which are arranged at least partly substantially opposite to one another in such a manner that a refiner chamber (12) is formed between them, to which the material to be defibrated is arranged to be fed. The first refining surface or the second refining surface has openings formed through them and through which fibrous material to be refined can be fed into the refiner chamber or through which refined fibrous material can be removed from the refiner chamber. In addition, a method for refining fibrous material, a refining surface of a refiner and a blade segment for a refiner.

19 Claims, 13 Drawing Sheets

A-A

A-A

B-B

REFINER AND METHOD FOR REFINING FIBROUS MATERIAL

CROSS REFERENCES TO RELATED APPLICATIONS

This application is a U.S. national stage application of International App. No. PCT/FI2009/050545, filed Jun. 18, 2009, the disclosure of which is incorporated by reference herein, and claims priority on Finnish App. No. 20080414, filed Jun. 19, 2008, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a refiner for refining fibrous material, the refiner comprising at least one first refining surface and at least one second refining surface, which are arranged at least partly substantially opposite to one another in such a manner that a refiner chamber is formed between them, to which the material to be defibrated is arranged to be fed, and at least either the first refining surface or the second refining surface in the refiner is arranged to move with respect to the opposite refining surface, and at least either the first refining surface or the second refining surface in the refiner comprises blade bars and blade grooves therebetween.

The invention further relates to a method for refining fibrous material, the method comprising refining fibrous material with a refiner which comprises at least one first refining surface and at least one second refining surface, which are arranged at least partly substantially opposite to one another in such a manner that a refiner chamber is formed between them, to which material to be defibrated is fed, and at least either the first refining surface or the second refining surface in the refiner is arranged to move with respect to the opposite refining surface, and at least either the first refining surface or the second refining surface in the refiner comprises blade bars and blade grooves therebetween.

The invention further relates to a refining surface for a refiner intended for refining fibrous material, the refiner comprising at least one first refining surface and at least one second refining surface, which are arranged at least partly substantially opposite to one another in such a manner that a refiner chamber is formed between them, to which the material to be defibrated is arranged to be fed, and at least either the first refining surface or the second refining surface in the refiner is arranged to move with respect to the opposite refining surface, and at least either the first refining surface or the second refining surface in the refiner comprises blade bars and blade grooves therebetween.

The invention further relates to a blade segment for a refiner intended for refining fibrous material, the blade segment comprising a refining surface with blade bars and blade grooves therebetween. Refiners for treating fibrous material typically comprise two, possibly even more refining surfaces substantially opposite to one another, between which there is a refiner chamber to which the fibrous material to be refined is fed. At least one of the refining surfaces is arranged to move with respect to the opposite refining surface. The refining surface may be one integral structure or it may consist of a plurality of refining surface segments arranged adjacent to one another, whereby the refining surfaces of individual refining surface segments form one uniform refining surface. The refining surfaces are typically provided with specific blade bars, i.e. bars, and blade grooves, i.e. grooves, therebetween, fibrous material being refined between the blade bars of the opposite refining surfaces and both the material to be refined and the already refined material being able to move in the blade grooves between the blade bars on the refining surface. On the other hand, the refining surface may comprise protrusions and recesses between the protrusions. The blade bars and blade grooves of the refining surfaces, or the protrusions and recesses of the refining surfaces, may be made of the basic material of the refiner blade or a separate material. The protrusions may also be formed of ceramic grits attached to the refining surface by previously known methods. The refining surfaces, i.e. the blade surfaces, may also be formed of separate lamellae arranged adjacent to or at a distance from one another and fixed to form a refining surface. The refining surface may also comprise a large number of small protrusions and recesses therebetween, in which case the refiner operates by a grinding principle.

The refiner chamber is a space which is formed between the refining surfaces of a stator and a rotor and where the refining takes place. The refining is caused by mutual pressing and motion of the refining surfaces as a result of frictional forces between the refining surfaces and the material to be refined and, on the other hand, due to frictional forces inside the material to be refined. The surface area between the refining surfaces of the rotor and the stator is the refining area, by which the refining between the refining surfaces of the rotor and the stator takes place in the refiner chamber. The shortest distance between the refining surfaces of the rotor and the stator in the region of the refining area is the blade gap.

To increase the production of refiners, it is important to guide the fibrous material to be refined efficiently between the opposite refining surfaces for refining. At the same time, it is naturally important to enable the removal of sufficiently refined material from between the refining surfaces in such a manner that the refined material does not block up the refiner chamber between the refining surfaces and thus weaken the production of the refiner. Particularly in refining surfaces comprising blade bars and blade grooves therebetween, the guiding of fibrous material between the opposite blade bars has been made more effective by providing o special dams on the bottom of the grooves, the dams forcing the material to be refined to move away from the bottom of the grooves to the space between the opposite refining surfaces. However, the effect of the dams is local and does not substantially benefit the whole area of the refining surface. The dams also diminish the hydraulic capacity of the refining surface considerably. Also by changing the height of the blade groove bottom and/or the volume of the blade groove it is possible to try to force the flow of material to be refined to move between the opposite refining surfaces and thus to make the refining more effective. In addition, by tilting the blade bars, it is possible to affect the flow of material to be refined and thus force the material to be refined to pass between the opposite blade bars.

A problem with all these solutions is, however, that they do not significantly improve the guiding of the material to be refined into the refiner chamber without simultaneously weakening the production capacity of the refiner.

SUMMARY OF THE INVENTION

It is an object of the present invention to provide a new type of refiner and a method, wherein the flow of material to be refined can be guided more efficiently into a refiner chamber between opposite refining surfaces and the operation of the refiner can thus be made more effective. The refiner of the invention is characterized in that the first refining surface comprises first openings formed through the first refining surface and through which fibrous material to be refined is arranged to be fed into the refiner chamber of the refiner, or that the second refining surface comprises second openings formed through the second refining surface and through which fibrous material to be refined is arranged to be fed into the refiner chamber of the refiner, or that the first refining surface comprises first openings formed through the first refining surface and through which refined fibrous material is arranged to be removed from the refiner chamber of the refiner, or that the second refining surface comprises second openings formed through the second refining surface and through which refined fibrous material is arranged to be removed from the refiner chamber of the refiner, and that the ratio of the surface area of said openings to the total area of the refining surface ranges from 5 to 70%, more preferably from 7 to 55%, and most preferably from 10 to 40%.

The method of the invention is characterized by feeding fibrous material to be refined through openings formed through the first refining surface into the refiner chamber between the refining surfaces of the refiner, or by feeding fibrous material to be refined through openings formed through the second refining surface into the refiner chamber between the refining surfaces of the refiner, or by removing refined fibrous material through the openings formed through the first refining surface from the refiner chamber or the refiner, or by removing refined fibrous material through the openings formed through the second refining surface from the refiner chamber of the refiner, the ratio of the surface area of the openings to the total area of the refining surface ranging from 5 to 70%, more preferably from 7 to 55%, and most preferably 10 to 40%.

The refining surface of the invention is characterized in that the refining surface comprises openings formed through the refining surface and through which fibrous material to be refined may be arranged to be fed into the refiner chamber of the refiner or removed from the refiner chamber of the refiner, and that the ratio of the surface area of said openings to the total area of the refining surface ranges from 5 to 70%, more preferably from 7 to 55%, and most preferably from 10 to 40%.

The blade segment of the invention is characterized in that the refining surface of the blade segment comprises openings formed through the refining surface, the ratio of the surface area of the openings to the total area of the refining surface ranging from 5 to 70%, more preferably from 7 to 55%, and most preferably from 10 to 40%.

The refiner for refining fibrous material comprises at least one first refining surface and at least one second refining surface, which are arranged at least partly substantially opposite to one another in such a manner that a refiner chamber is formed between them, to which the material to be defibrated is arranged to be fed. Further in the refiner, at least either the first refining surface or the second refining surface is arranged to move with respect to the opposite refining surface and at least either the first refining surface or the second refining surface comprises blade bars and blade grooves therebetween. The first refining surface of the refiner further comprises first openings formed through the first refining surface and through which fibrous material to be refined is arranged to be fed into the refiner chamber of the refiner, or the second refining surface of the refiner comprises second openings formed through the second refining surface and through which fibrous material to be refined is arranged to be fed into the refiner chamber of the refiner, or that the first refining surface comprises first openings formed through the first refining surface and through which refined fibrous material is arranged to be removed from the refiner chamber of the refiner, or that the second refining surface comprises second openings formed through the second refining surface and through which refined fibrous material is arranged to be removed from the refiner chamber of the refiner. Furthermore, the ratio of the surface area of said openings to the total area of the refining surface ranges from 5 to 70%, more preferably from 7 to 55%, and most preferably from 10 to 40%.

Thus, the refiner chamber is a space which is formed between the refining surfaces of a rotor and a stator and where the refining takes place. The surface area formed between the refining surfaces of the rotor and the stator is the refining area, by which the refining between the refining surfaces of the rotor and the stator takes place in the refiner chamber. In the context of this specification and the claims, the term "blade bar" also refers to the previously mentioned protrusions and the term "blade groove" also refers to the recesses between said protrusions.

The refining surface of the refiner's rotor or stator is provided with openings, when the distance between the edge of an opening and the edge of the closest, second opening, i.e. the measurement of the space without openings, is under 200 mm. More preferably the distance from the edge of an opening to the edge of the closest, second opening is under 100 mm. Most preferably the distance from the edge of an opening to the edge of the closest, second opening is under 50 mm.

If there are openings only on one refining surface, it is advantageous for both the production and the refining result of the refined fiber suspension to provide openings close to one another, which results in a high yield and a good quality of a refined fiber suspension, since material to be refined can be fed efficiently into the refiner chamber and distributed evenly in the refiner chamber. If there are openings on both refining surfaces defining the refiner chamber, a good yield is primarily affected by the total area of the openings.

However, the refining result improves when the openings are not located too densely, which means that the material to be refined stays in the refiner chamber a longer time before it is discharged and undergoes a refining treatment resulting in a good pulp quality. On the other hand, when openings are densely located, the material to be refined is efficiently guided directly to each blade bar for refining, and the refiner blades are utilized efficiently for refining treatment. When a refiner with densely located openings is used with a great flow-through, the production is high and refining is relatively efficient. By reducing the flow-through, or production, the refining time can be made longer, and also a blade with densely located openings provides a sufficient residence time in the refiner chamber and a good pulp quality.

By feeding fibrous material to be refined through the openings formed through either the first refining surface or the second refining surface, it is possible to feed fibrous material into the refiner chamber more efficiently and more evenly than before, so that the distribution of the material to be refined in the refiner chamber is more even than previously. This makes the refining more effective and thus increases the capacity of the refiner. Alternatively, by removing refined fibrous material through the openings formed through either the first refining surface or the second refining surface away from the refiner chamber, it is possible to remove refined fibrous material from the refiner chamber more efficiently, and the risk of blocking up the refiner decreases. This also makes the refining more effective and thus increases the capacity of the refiner. At the same time, the efficiency of the refiner or the refining compared to the previously known solutions may be further improved as the ratio of the surface area of said openings to the total area of the refining surface ranges from 5 to 70%, more preferably from 7 to 55%, and most preferably 10 to 40%.

According to an embodiment of the invention, the first refining surface comprises openings formed through the first refining surface and through which fibrous material to be refined is arranged to be fed into the refiner chamber of the refiner, and the second refining surface comprises openings provided through the second refining surface and through which fibrous material refined in the refiner is arranged to be removed from the refiner chamber.

According to a second embodiment of the invention, the second refining surface comprises openings formed through the second refining surface and through which fibrous material to be refined is arranged to be fed into the refiner chamber of the refiner, and the first refining surface comprises openings formed through the first refining surface and through which fibrous material refined in the refiner is arranged to be removed from the refiner chamber.

By feeding fibrous material to be refined through the first refining surface into the refiner chamber and removing the already refined fibrous material from the refiner chamber through the second refining surface essentially opposite to the first refining surface or vice versa, it is possible to feed fibrous material into the refiner chamber more efficiently and more evenly than before. As a result, the distribution of the material to be refined in the refiner chamber is more even than previously, which also increases the efficiency and thus capacity of the refiner. While material to be refined is removed from the refiner chamber through the openings formed through either the first refining surface or the second refining surface, refined material can be efficiently removed from the refiner chamber. This reduces the risk of blocking up the refining surface, which in turn further increases the efficiency and thus capacity of the refiner.

According to a third embodiment of the invention, the material to be refined is arranged to be fed into the refiner chamber through the openings that are only provided in either the first refining surface or the second refining surface.

BRIEF DESCRIPTION OF THE DRAWINGS

Some embodiments of the invention will be described in more detail in the attached drawings.

In the figures, some embodiments of the invention are shown simplified for the sake of clarity. Similar parts are marked with the same reference numbers in the figures.

DESCRIPTION OF THE PREFERRED EMBODIMENTS

Figure 1:
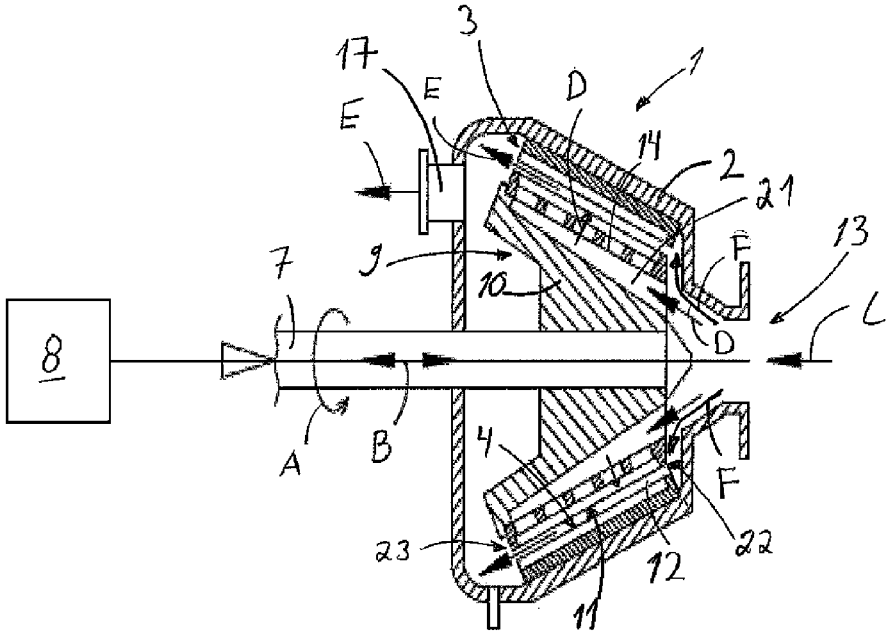
FIG. 1 schematically shows a side view of a cone refiner in cross-section.
Figure 6:
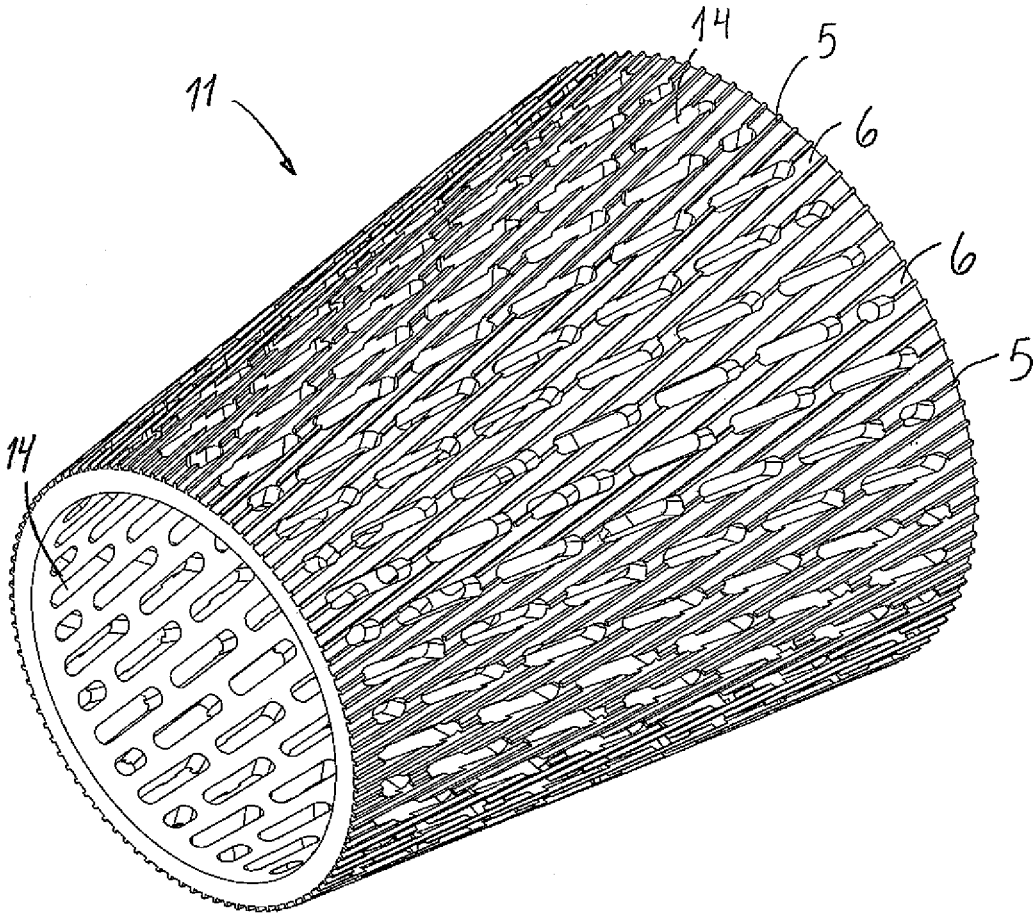
FIG. 6 schematically shows a conical refining surface axonometrically.

FIG. 1 schematically shows a side view of a cone refiner 1 partly in cross-section, which can be used for refining fibrous material, such as material used for manufacturing paper or paperboard. The refiner 1 shown in FIG. 1 comprises a frame 2 and a stationary, fixed refiner element 3, i.e. stator 3, supported to the frame 2 and provided with a refining surface 4. The refining surface may comprise blade bars 5 and blade grooves 6 therebetween, as shown by way of example in FIG. 6. The blade bars and the blade grooves therebetween, belonging to the refining surface of FIG. 6, are provided on a blade surface, i.e. refining surface performing the refining treatment for fibrous material. The refiner 1 further comprises a refiner element 9 arranged to be rotated by a shaft 7 and a highly schematically depicted motor 8 by way of example in the direction of arrow A, for instance, which refiner element may, due to the rotational motion, in the case of FIG. 1 also be called a rotor 9 of the refiner 1. The movable refiner element 9 comprises a body 10 and a refining surface 11 possibly comprising blade bars and blade grooves. The refiner 1 may also comprise a loader not shown in FIG. 1 for the sake of clarity, which can be used for moving the movable refiner element 9 attached to the shaft 7 back and forth, as shown schematically by arrow B, in order to adjust the size of a refiner chamber 12, and thus that of the blade gap, between the refining surface 4 of the fixed refiner element 3 and the refining surface 11 of the movable refiner element 9.

In the embodiment of FIG. 1, the body 10 of the rotor 9 has a partially hollow structure so that there is a somewhat open space 21 under the refining surface 11 of the rotor 9. Fibrous material to be refined is fed through a feed opening 13 or feed channel into the refiner 1 from the end of the conical structure having a smaller diameter in a manner shown schematically by arrow C. The majority of the fibrous material fed into the refiner 1 passes into the open space 21 under the refining surface 11 of the rotor 9, as shown by arrows D, and from there through openings 14 formed through the refining surface 11 of the rotor 9 into the refiner chamber 12, where fibrous material is refined. The openings 14, through which fibrous material to be refined can be fed into the refiner chamber 12, may be arranged on the refining surface 11 to cover, for instance, at least 60% of the refining area and, most preferably, the entire refining area.

Since the space between the rotor 9 and the frame 2 of the refiner is not fully closed, part of the fibrous material to be fed into the refiner 1 according to FIG. 1 may transfer into the refiner chamber 12 from a first edge 22 of the blade gap 12 of the refiner chamber, as shown by arrows F. Refined material exits the refiner chamber 12 from its second edge 23 and further out of the refiner 1 via a discharge channel 17 or discharge opening, as shown schematically by arrows E. In the embodiment of FIG. 1, the refining surface 11 of the movable refiner element 9 constitutes the first refining surface of the refiner 1 and the openings 14 formed through the refining surface 11 constitute first openings formed through the first refining surface and through which fibrous material to be refined may be fed into the refiner chamber 12. The refining surface 4 of the fixed refiner element 3 in turn constitutes the second refining surface of the refiner 18.

Figure 2:
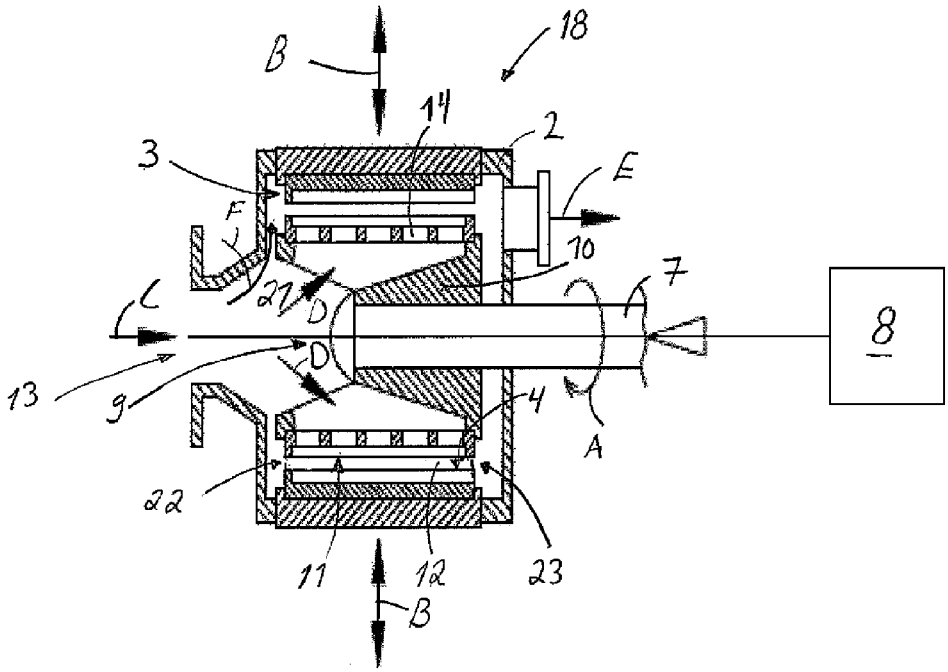
FIG. 2 schematically shows a side view of a cylindrical refiner in cross-section.

By feeding fibrous material to be refined through the openings formed through the first refining surface, i.e. the refining surface of the rotor, into the refiner chamber, it is possible to feed fibrous material into the refiner chamber more efficiently and more evenly than before, so that the distribution of the material to be refined in the refiner chamber is more even than previously. This makes the refining more effective and thus increases the capacity of the refiner. The efficiency of the refiner or the refining compared to the previously known solutions can be further improved when the ratio of the surface area of said openings to the total area of the refining surface ranges from 5 to 70%, more preferably from 7 to 55%, and most preferably 10 to 40%, for instance from 16 to 17%. Also, the efficiency of the refiner compared to the known solutions may be further improved when said openings are arranged on said refining surface to cover, for instance, at least 60% of the refining area. In addition, as at least either the movable refining surface or the fixed refining surface comprises blade bars and blade grooves therebetween, it is possible to intensify the refining effect directed at the fibers with respect to refiners in which the refining surfaces do not comprise blade bars or blade grooves between them. FIG. 2 schematically shows a side view of a cylindrical refiner 18 in cross-section, which is used for refining fibrous material, such as material used for manufacturing paper or paperboard. The refiner 18 shown in FIG. 2 comprises a frame 2 and a stationary, fixed refiner element 3, i.e. stator 3, supported to the frame 2 and provided with a refining surface 4. The refining surface 4 may comprise blade bars and blade grooves therebetween. The refiner 18 further comprises a refiner element 9, i.e. rotor 9, arranged to be rotated by a shaft 7 and a highly schematically depicted motor 8, by way of example, in the direction of arrow A, for instance. The rotor 9 comprises a body 10 and a refining surface 11 possibly composed of blade bars and blade grooves. In the embodiment of FIG. 2, the majority of the body 10 of the rotor 9 has a hollow structure so that there is an open space 21 under the refining surface 11 inside the rotor 9 body 10. The refiner 18 of FIG. 2 may also comprise an adjustment structure for adjusting the size of the refiner chamber 12 between the refining surface 4 of the stator 3 and the refining surface 11 of the rotor 9 in the direction schematically shown by arrows B. The adjustment may be carried out by previously known manners, in which the distance between at least one refining surface and the other refining surface is adjusted. To enable the adjustment, the adjustable refining surface is sectionalized. The adjustment is performed by a screw or wedge mechanism or a hydraulic loading mechanism.

The fibrous material to be refined is fed into the refiner 18 via a feed opening 13 or feed channel in a manner shown schematically by arrow C. The majority of the fibrous material fed into the refiner 18 passes into the open space 21 under the refining surface 11 of the rotor 9, as shown by arrows D, and from there through openings 14 formed through the refining surface 11 of the rotor 9 into the refiner chamber 12, where fibrous material is refined. The openings 14, through which fibrous material to be refined can be fed into the refiner chamber 12, may be arranged on the refining surface 11 to cover, for instance, at least 60% of the refining area, preferably at least 80% of the refining area, and most preferably to cover the entire refining area. However, said openings may also be arranged on the refining surface 11 to cover less than 60% of the refining area.

Since the space between the rotor 9 and the frame 2 of the refiner 18 is not fully closed, part of the fibrous material to be fed into the refiner 18 according to FIG. 2 may transfer into the refiner chamber 12 from a first edge 22 of the refiner chamber 12, as shown by arrows F. Refined material exits the refiner chamber 12 from its second edge 23 and further out of the refiner 18 via a discharge channel 17 or discharge opening, as shown schematically by arrows E.

In the embodiment of FIG. 2, the refining surface 11 of the movable refiner element 9 constitutes the first refining surface of the refiner 18 and the openings 14 formed through the refining surface 11 constitute first openings formed through the first refining surface and through which fibrous material to be refined may be fed into the refiner chamber 12. The refining surface 4 of the fixed refiner element 3 in turn constitutes the second refining surface of the refiner 18.

Figure 3:
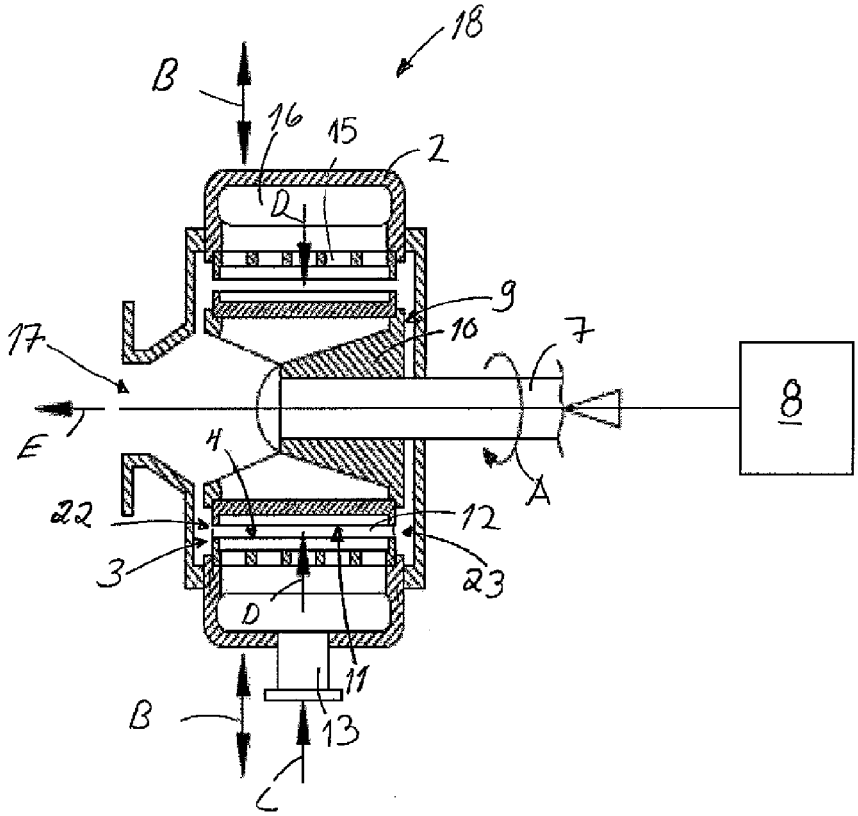
FIG. 3 schematically shows a side view of a second cylindrical refiner in cross-section.

FIG. 3 schematically shows a side view of a second cylindrical refiner 18 partially in cross-section, the structure of the cylindrical refiner according to FIG. 3 resembles the cylindrical refiner of FIG. 2, yet with the following exceptions. In the refiner 18 according to FIG. 3, the stator 3 is supported to the frame 2 of the refiner 1 in such a manner that an intermediate space 16 remains between the stator 3 and the frame 2. In addition, the refiner 18 of FIG. 3 comprises openings 15 in the refining surface 4 of the stator 3 and the refining surface 11 of the rotor 9 does not have openings 14. The fibrous material to be refined is fed into the refiner 18 via a feed opening 13 or feed channel in a manner shown schematically by arrow C. The fibrous material fed into the refiner 18 passes, as shown by arrows D, through the openings 15 formed through the refining surface 4 of the stator 3 into the refiner chamber 12, where fibrous material is refined.

The openings 15, through which fibrous material to be refined can be fed into the refiner chamber 12, may be arranged on the refining surface 4 to cover, for instance, at least 60%, preferably at least 80% of the refining area, and most preferably to cover the entire refining area. However, said openings 15 may also be arranged on the refining surface 11 to cover less than 60% of the refining area. The ratio of the surface area of said openings 15 to the total area of the refining surface 4 can be arranged to range from 5 to 70%, more preferably from 7 to 55%, and most preferably from 10 to 40%, for instance from 16 to 17%. Refined material exits the refiner chamber 12 from its second edge 23 and further out of the refiner 18 via a discharge opening 17 or discharge channel, as shown schematically by arrows E. In the embodiment of FIG. 3, as fibrous material is fed into the refiner, all fibrous material to be fed into the refiner passes through the openings 15 in the refining surface 4 of the stator 3 into the refiner chamber 12.

In the embodiment of FIG. 3, the refining surface of the movable refiner element constitutes the first refining surface of the refiner 18. The refining surface 4 of the fixed refiner element 3 in turn constitutes the second refining surface of the refiner 18 and the openings 15 formed through the refining surface 4 constitute second openings formed through the second refining surface and through which fibrous material to be refined may be fed into the refiner chamber 12.

By alternatively feeding fibrous material to be refined through the openings formed through the second refining surface, i.e. refining surface of the stator, into the refiner chamber, it is also then possible to feed fibrous material into the refiner chamber more efficiently and more evenly than before, so that the distribution of the material to be refined in the refiner chamber is more even than previously. The efficiency of the refiner or the refining compared to the previously known solutions may be further improved when the ratio of the surface area of said openings to the total area of the refining surface ranges from 5 to 70%, more preferably from 7 to 55%, and most preferably 10 to 40%, for instance from 16 to 17%. At the same time, the efficiency of the refiner compared to the known solutions may be further improved when said openings are arranged on said refining surface to cover, for instance, at least 60% of the refining area.

Figure 4:
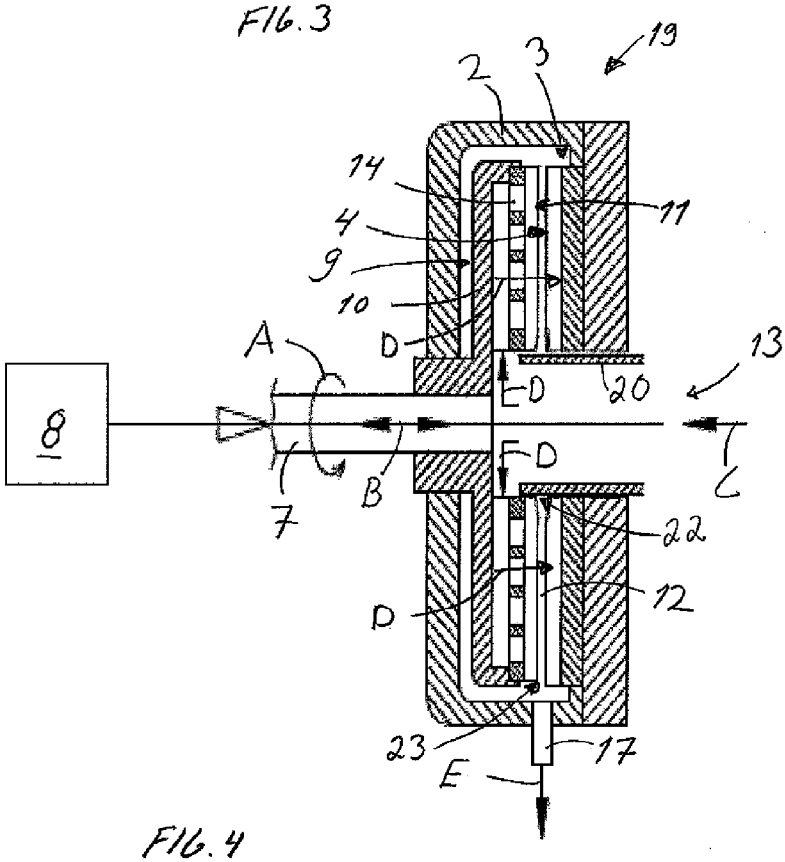
FIG. 4 schematically shows a side view of a disc refiner in cross-section.

FIG. 4 schematically shows a side view of a disc refiner 19 partly in cross-section, which can be used for refining fibrous material, such as material used for manufacturing paper or paperboard. The refiner 19 shown in FIG. 4 comprises a frame 2 and a stationary, fixed refiner element 3, i.e. stator 3, supported to the frame 2 and provided with a refining surface 4. As stated above, the refining surface 4 may comprise blade bars and blade grooves therebetween. The refiner 19 further comprises a refiner element 9, i.e. a refiner 19 rotor 9, arranged to be rotated by a shaft 7 and a highly schematically depicted motor 8, by way of example, in the direction of arrow A, for instance. The movable refiner element 9 comprises a body 10 and a refining surface 11 possibly composed of blade bars and blade grooves. The refiner 19 may also comprise a loader not shown in FIG. 4 for the sake of clarity, which can be used for moving the movable refiner element 9 attached to the shaft 7 back and forth, as shown schematically by arrow B, in order to adjust the size of a refiner chamber 12, and thus that of the blade gap, between the refining surface 4 of the fixed refiner element 3 and the refining surface 11 of the movable refiner element 9.

In the embodiment of FIG. 4, the body 10 of the rotor 9 has a partially hollow structure so that there is a somewhat open space 21 behind the refining surface 11 of the rotor 9. The fibrous material to be refined is fed into the refiner 19 through a feed opening 13 or feed channel in a manner shown schematically by arrow C. The fibrous material fed into the refiner 19 passes into the open space 21 behind the refining surface 11 of the rotor 9, as shown by arrows D, and from there through openings 14 formed through the refining surface 11 of the rotor 9 into the refiner chamber 12, where fibrous material is refined. Feeding of fibrous material to be refined directly into the refiner chamber 12 is prevented by a protective structure 20.

The openings 14, through which fibrous material to be refined can be fed into the refiner chamber 12, may be arranged on the refining surface 11 to cover at least 60%, preferably at least 80% of the refining area, and most preferably to cover the entire refining area. The ratio of the surface area of the openings 14 to the total area of the refining surface 11 can be arranged to range from 5 to 70%, more preferably from 7 to 55%, and most preferably from 10 to 40%, for instance from 16 to 17%. In the embodiment of FIG. 4, the refining surface 11 of the movable refiner element 9 constitutes the first refining surface of the refiner 19 and the openings 14 formed through the refining surface 11 constitute first openings provided through the first refining surface and through which fibrous material to be refined may be fed into the refiner chamber 12. The refining surface 4 of the fixed refiner element 3 in turn constitutes the second refining surface of the refiner 1. Refined material exits the refiner chamber 12 from its second edge 23 and further out of the refiner 19 via a discharge channel 17 or discharge opening, as shown schematically by arrows E.

Figure 5:
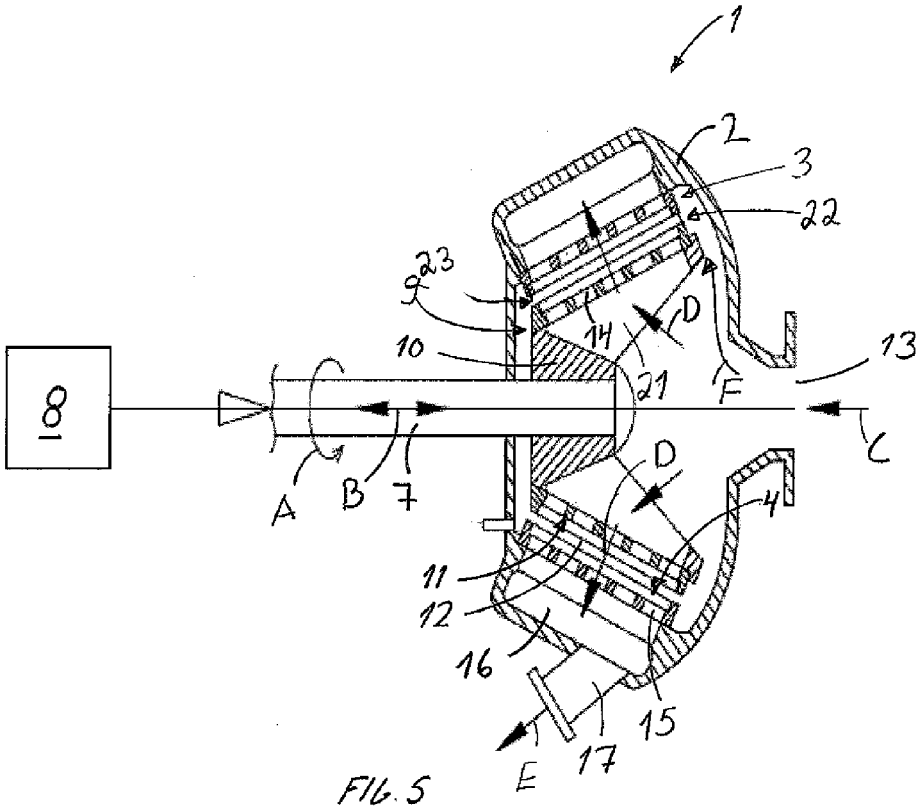
FIG. 5 schematically shows a side view of a second cone refiner in cross-section.

FIG. 5 schematically shows a side view of a second cone refiner 1 in cross-section, FIG. 6, for its part, shows schematically and axonometrically a conical refining surface which may be used, for example, as a refining surface of the rotor in the refiner according to FIG. 5. The structure of the refiner 1 shown in FIG. 5 resembles the refiner 1 according to FIG. 1, with the exception, however, that the refining surface 4 of the stator 3 comprises openings 15 extending through it, and that the frame 2 is arranged in such a manner that an intermediate space 16 remains between the frame 2 and the stator 3 supported to the frame 2, the intermediate space 16 being provided with a discharge channel 17 or discharge opening for discharging the refined material from the refiner 1.

The fibrous material to be refined is fed into the refiner 1 via a feed opening 13 or feed channel in a manner shown schematically by arrow C. The majority of the fibrous material fed into the refiner 1 passes into an open space 21 under or behind the refining surface 11 of the rotor 9, as shown by arrows D, and from there through openings 14 formed through the refining surface 11 of the rotor 9 into the refiner chamber 12. The refined material is able to pass from the refiner chamber 12 through the openings 15 in the refining surface 4 of the stator 3 into the intermediate space 16 between the refiner 1 frame 2 and the stator 3, from where the refined material is removed via the discharge channel 17 or discharge opening out of the refiner 1, as shown schematically by arrow E. Since the space between the rotor 9 and the frame 2 of the refiner 1 is not fully closed, part of the fibrous material to be fed into the refiner 1 according to FIG. 5 may transfer into the refiner chamber 12 from a first edge 22 of the refiner chamber 12, as shown by arrow F. Refined material may also exit from a second edge 23 of the refiner chamber 12, from where there is a connection to the intermediate space 16 between the refiner 1 frame 2 and the stator 3.

In the embodiment of FIG. 5, the refining surface 11 of the rotor 9 constitutes the first refining surface of the refiner, and the openings 14 formed through the refining surface 11 of the rotor 9 constitute first openings formed through the first refining surface and through which material to be refined is fed into the refiner chamber between the refining surfaces of the refiner. Further in the embodiment of FIG. 5, the refining surface 4 of the stator 3 constitutes the second refining surface of the refiner, and the openings 15 formed through the refining surface 4 of the stator 3 constitute second openings formed through the second refining surface and through which fibrous material refined in the refiner chamber is removed from the refiner chamber.

The openings 14, through which fibrous material to be refined can be fed into the refiner chamber 12, or the openings 15, through which refined fibrous material can be removed from the refiner chamber 12, may be arranged on the refining surfaces 4 and 11 to cover, for instance, at least 60%, preferably at least 80% of the refining area, and most preferably to cover the entire refining area. The ratio of the surface area of the openings to the total area of the refining surface can be arranged to range from 5 to 70%, more preferably from 7 to 55%, and most preferably from 10 to 40%, for instance from 16 to 17%. Compared to FIG. 1, it is to be noted that in FIG. 5 the end of the cone structure of the refiner 1 having a larger diameter is here directed towards the direction in which fibrous material to be refined is fed into the refiner 1, and the cone structure end with a smaller diameter is directed away from the direction in which material to be refined is fed into the refiner 1.

In the embodiment of FIG. 5, the openings 14 in the refining surface 11 of the rotor 9 make the feeding of the fibrous material to be refined into the refiner chamber 12 effective, whereby the fibrous material can be refined more efficiently than before. In addition, due to the openings 14 in the refining surface 11 of the rotor 9, the fibrous material to be refined is fed into the refiner chamber 12 more evenly than previously so that the distribution of the material to be refined in the refiner chamber 12 is more even than previously, which in turn also increases the efficiency of the refining and thus the capacity of the refiner. Because of the openings 15 in the refining surface 4 of the stator 3 of the refiner 1, refined pulp can be transferred away from the refiner chamber 12 more efficiently than before, which reduces the risk of blocking up the refiner and also advances the operation of the refiner.

Figure 7:
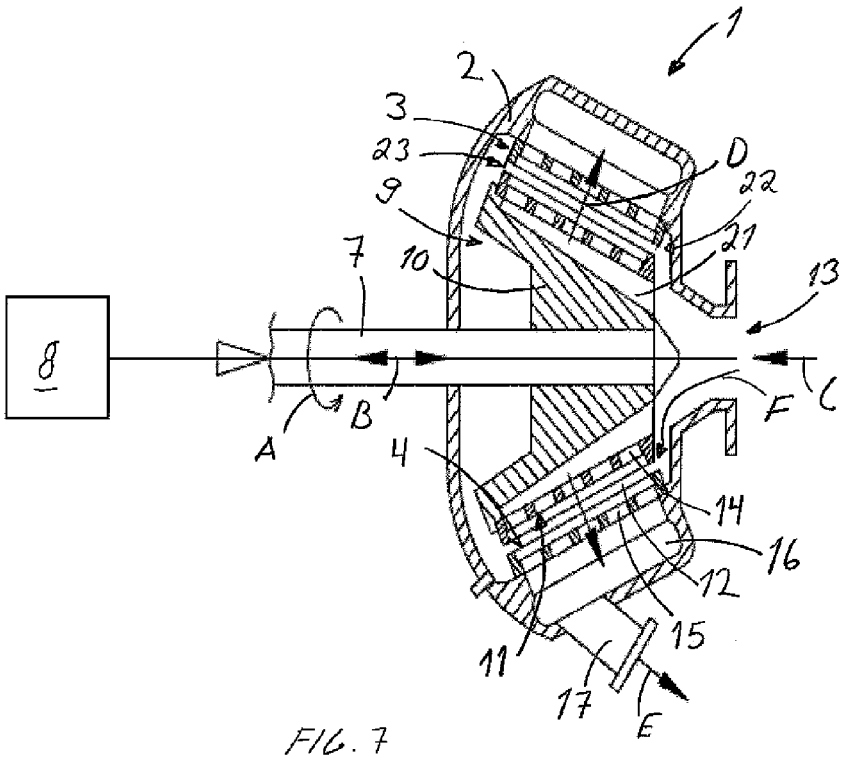
FIG. 7 schematically shows a side view of a third cone refiner in cross-section.

FIG. 7 schematically shows a side view of a third cone refiner 1 in cross-section. The cone refiner 1 shown in FIG. 7 differs from the cone refiner of FIG. 5 in that the inclination direction of the cone structure of the refiner shown in FIG. 7 is opposite to that of the cone structure of the refiner shown in FIG. 5. In other words, in the refiner of FIG. 7 the end of the cone structure having a larger diameter is directed away from the direction in which material to be refined is fed into the refiner, whereas in the refiner of FIG. 5 the end of the cone structure with a larger diameter is directed towards the direction in which material to be refined is fed into the refiner. Furthermore, the structure of the rotor 9 body 10 of the refiner shown in FIG. 7 is similar to that in FIG. 1, whereupon the open space under or behind the refining surface 11 of the rotor 9 is smaller in the refiner of FIG. 7 than in the refiner of FIG. 5. Otherwise, the operation of the refiner shown in FIG. 7 corresponds to the operation of the refiner shown in FIG. 5.

Figure 8:
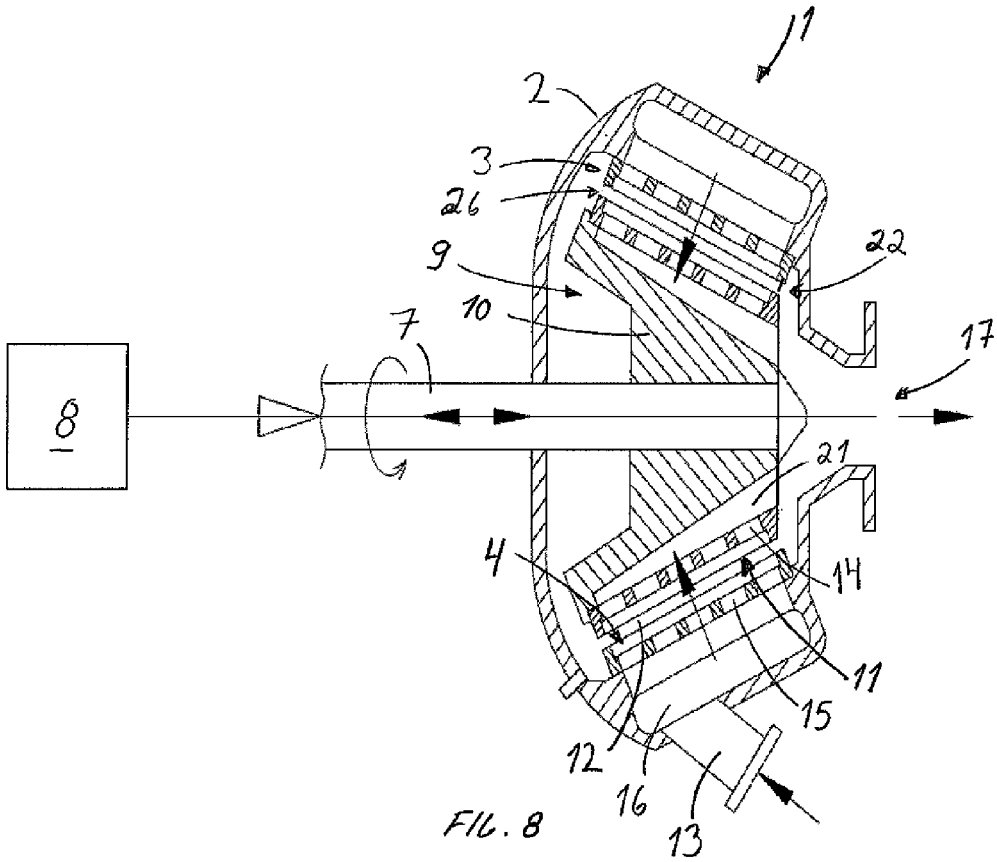
FIG. 8 schematically shows a side view of a fourth cone refiner in cross-section.

FIG. 8 schematically shows a side view of a fourth cone refiner 1 for refining fibrous material in cross-section. The basic structure of the cone refiner shown in FIG. 8 corresponds to that of the refiner of FIG. 7, but the refiner of FIG. 8 operates in an opposite manner compared to the refiner of FIG. 7. This means that in the refiner shown in FIG. 8, the feed channel 13 or feed opening for feeding fibrous material into the refiner is arranged on the outer circumference of the refiner 1, and the discharge opening 17 or discharge channel for removing refined material from the refiner is arranged in the center section of the refiner 1 in a location where the refiner of FIG. 7 comprises a feed opening 13 for feeding material to be refined into the refiner. In the refiner of FIG. 8, the fibrous material to be refined is thus first fed via the feed channel 13 or feed opening of the refiner 1 into the intermediate space 16 between the refiner 1 frame 2 and the stator 3 of the refiner 1, from where the material to be refined passes further into the refiner chamber 12 through the openings 15 in the refining surface 4 of the refiner's stator 3. The majority of the refined material is removed from the refiner chamber 12 through the openings 14 in the refining surface 11 of the rotor 9 and a small amount is possibly removed as a leakage flow from the end of the refiner chamber 12 on the right-hand side in FIG. 8, corresponding to the first edge of the refiner chamber 12 in FIGS. 1, 5 and 7, and further out of the refiner from the space between the rotor 9 and the refiner 1 frame 2, as shown schematically by arrow E.

In the embodiment of FIG. 8, the refining surface 11 of the movable refiner element 9, i.e. the rotor 9, constitutes the first refining surface of the refiner, and the openings 14 formed through the refining surface 11 of the rotor 9 constitute first openings formed through the first refining surface and through which fibrous material refined in the refiner chamber 12 is removed from the refiner chamber. Further in the embodiment of FIG. 8, the refining surface 4 of the fixed refiner element 3, i.e. the stator 3, constitutes the second refining surface of the refiner, and the openings 15 formed through the refining surface 4 of the stator 3 constitute second openings formed through the second refining surface and through which material to be refined is fed into the refiner chamber 12 between the refiner's refining surfaces. Further in the embodiment of FIG. 8, the openings 15, through which fibrous material to be refined can be fed into the refiner chamber 12, are arranged on the refining surface 4 to cover at least 60%, preferably at least 80% of the refining area, and most preferably to cover the entire refining area. Accordingly, the openings 14, through which refined material can be removed from the refiner chamber 12, are arranged on the refining surface 11 to cover at least 60%, preferably at least 80% of the refining area, and most preferably to cover the entire refining area.

Figure 9:
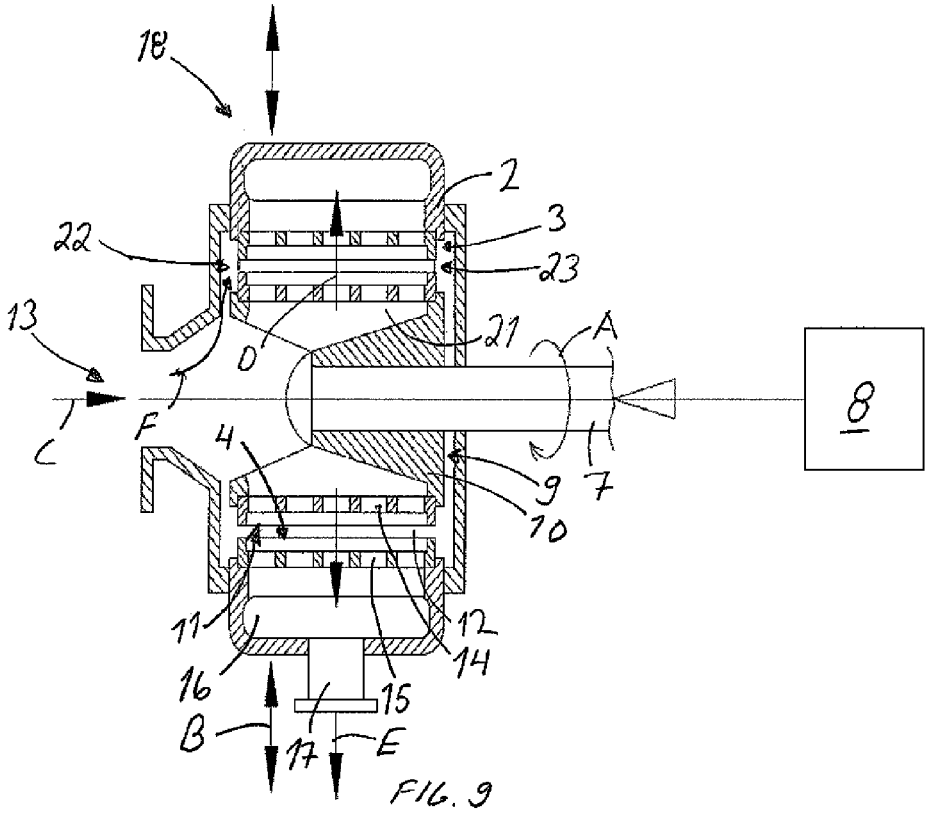
FIG. 9 schematically shows a side view of a third cylindrical refiner in cross-section.

FIG. 9 schematically shows a side view of a third cylindrical refiner 18 in cross-section for refining fibrous material, such as material used for manufacturing paper or paperboard. The structure of the refiner 18 shown in FIG. 9 resembles the cylindrical refiner shown in FIG. 3. However, the refiner shown in FIG. 9 differs from the refiner of FIG. 3 in that the refining surface 11 of the rotor 9 of the refiner 18 shown in FIG. 9 comprises openings 14 extending through the refining surface 11. The fibrous material to be refined may be fed into the refiner 18 through a feed opening 13 or feed channel, as shown by arrow C. The majority of the fibrous material fed into the refiner 18 passes into an open space under or behind the refining surface 11 of the rotor 9 and through the openings 14 formed through the refining surface 11 of the rotor 9 into the refiner chamber 12, as shown by arrows D. The refined material is able to exit the refiner chamber 12 through the openings 15 in the refining surface 4 of the stator 3 into an intermediate space 16 between the refiner 18 frame 2 and the stator 3, from where the refined material is removed via the discharge channel 17 or discharge opening out of the refiner 18, as shown schematically by arrow E. Since the space between the rotor 9 and the frame 2 of the refiner 18 is not fully closed, part of the fibrous material to be fed into the refiner 18 may transfer into the refiner chamber 12 from a first edge 22 of the refiner chamber 12 in FIG. 9, as shown by arrows F. Refined material may also exit the refiner chamber 12 from a second edge 23 of the blade gap 12 in FIG. 9, from where there is a connection to the intermediate space 16 between the refiner 18 frame 2 and the stator 3.

In the embodiment of FIG. 9, the refining surface 11 of the movable refiner element 9, i.e. the rotor 9, constitutes the first refining surface of the refiner, and the openings 14 formed through the refining surface 11 of the rotor 9 constitute first openings formed through the first refining surface and through which material to be refined is fed into the refiner chamber between the refining surfaces of the refiner. Further in the embodiment of FIG. 9, the refining surface 4 of the fixed refiner element 3, i.e. the stator 3, constitutes the second refining surface of the refiner, and the openings 15 formed through the refining surface 4 of the stator 3 constitute second openings formed through the second refining surface and through which fibrous material refined in the refiner chamber 12 is removed from the refiner chamber.

Further in the embodiment of FIG. 9, the openings 14, through which fibrous material to be refined can be fed into the refiner chamber 12, are arranged on the refining surface 11 to cover at least 60%, preferably at least 80% of the refining area, and most preferably to cover the entire refining area. Accordingly, the openings 15, through which refined material can be removed from the refiner chamber 12, are arranged on the refining surface 4 to cover at least 60%, preferably at least 80% of the refining area, and most preferably to cover the entire refining area.

In the cylindrical refiner 18 of FIG. 9, feeding of fibrous material into the refiner may also be arranged such that the fibrous material to be refined is fed into the intermediate space 16 and from there further through the openings 15 in the refining surface 4 of the stator 3 into the refiner chamber 12, and refined material is removed from the refiner chamber 12 through the openings 14 in the refining surface 11 of the rotor 9. In this case, the feed channel or feed opening for feeding fibrous material to be refined into the refiner and the discharge channel or discharge opening for removing the refined material from the refiner change places with one another.

Figure 10:
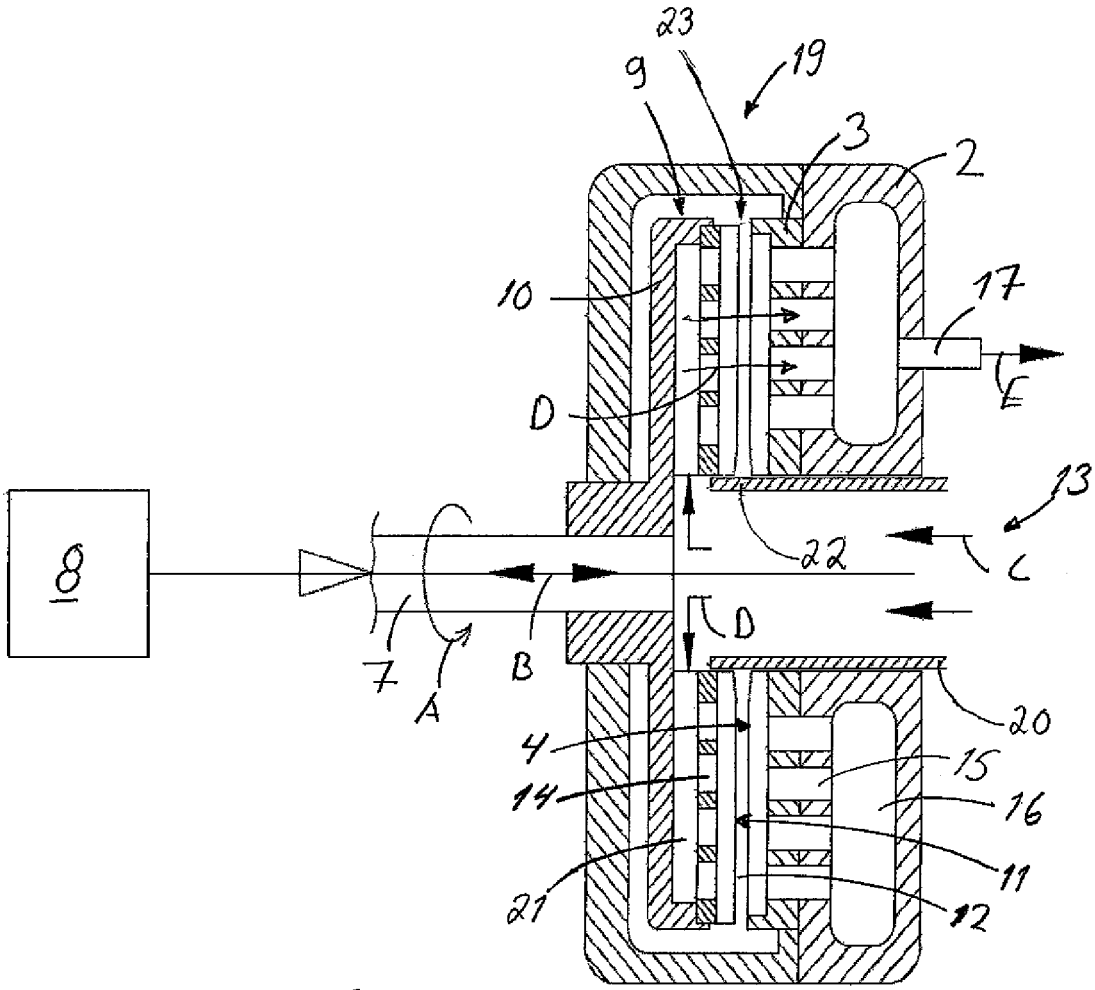
FIG. 10 schematically shows a side view of a second disc refiner in cross-section.

FIG. 10 schematically shows a side view of a second disc refiner 19 in cross-section. The structure of the refiner 19 shown in FIG. 10 resembles the refiner according to FIG. 4. However, unlike the structure of the disc refiner of FIG. 4, the refiner of FIG. 10 comprises openings 15 formed through the refining surface 4 of the stator 3 and there is an intermediate space 16 between the stator 3 and the refiner 19 frame 2.

The fibrous material to be refined is fed into the refiner 19 via a feed opening 13 or feed channel in a manner shown schematically by arrow C. The fibrous material fed into the refiner 19 passes into an open space 21 behind the refining surface 11 of the rotor 9, as shown by arrows D, and from there through openings 14 formed through the refining surface 11 of the rotor 9 into the refiner chamber 12, as shown by arrows D. The refined material is able to pass through the openings 15 in the refining surface 4 of the stator 3 into the intermediate space 16 between the refiner 19 frame 2 and the stator 3, from where the refined material is removed via a discharge channel 17 or discharge opening out of the refiner 19, as shown schematically by arrow E. Refined material may also exit the refiner chamber 12 from the outer circumference of the refining surfaces 4, 11, from where there is also a connection to the intermediate space 16 between the refiner 19 frame 2 and the stator 3. Transfer of material to be refined and fed into the refiner from the feed opening 13 directly to the refiner chamber 12 is prevented by a protective structure 20.

In the embodiment of FIG. 10, the refining surface 11 of the movable refiner element 9, i.e. the rotor 9, constitutes the first refining surface of the refiner, and the openings 14 formed through the refining surface 11 of the rotor 9 constitute first openings formed through the first refining surface and through which material to be refined is fed into the refiner chamber between the refining surfaces of the refiner. Further in the embodiment of FIG. 10, the refining surface 4 of the fixed refiner element 3, i.e. the stator 3, constitutes the second refining surface of the refiner, and the openings 15 formed through the refining surface 4 of the stator 3 constitute second openings formed through the second refining surface and through which fibrous material refined in the refiner chamber 12 is removed from the refiner chamber.

The openings 14, through which fibrous material to be refined can be fed into the refiner chamber 12, are arranged on the refining surface 11 to cover at least 60%, preferably at least 80% of the refining area, and most preferably to cover the entire refining area.

As was described above in connection with cone refiners and cylindrical refiners, in disc refiners, too, the feeding of fibrous material into the disc refiner 19 may be arranged in such a manner that fibrous material to be refined is fed into the intermediate space 16, from where it passes through the openings 15 in the refining surface 4 of the stator 3 into the refiner chamber 12. The refined material may in turn be removed from the refiner chamber 12 through the openings 14 in the refining surface 11 of the rotor 9. In this case, the feed opening 13 or feed channel 13 for feeding fibrous material to be refined into the refiner 19 and the discharge channel 17 or discharge opening for removing the refined fibrous material from the refiner 19 change places with one another.

Figure 11:
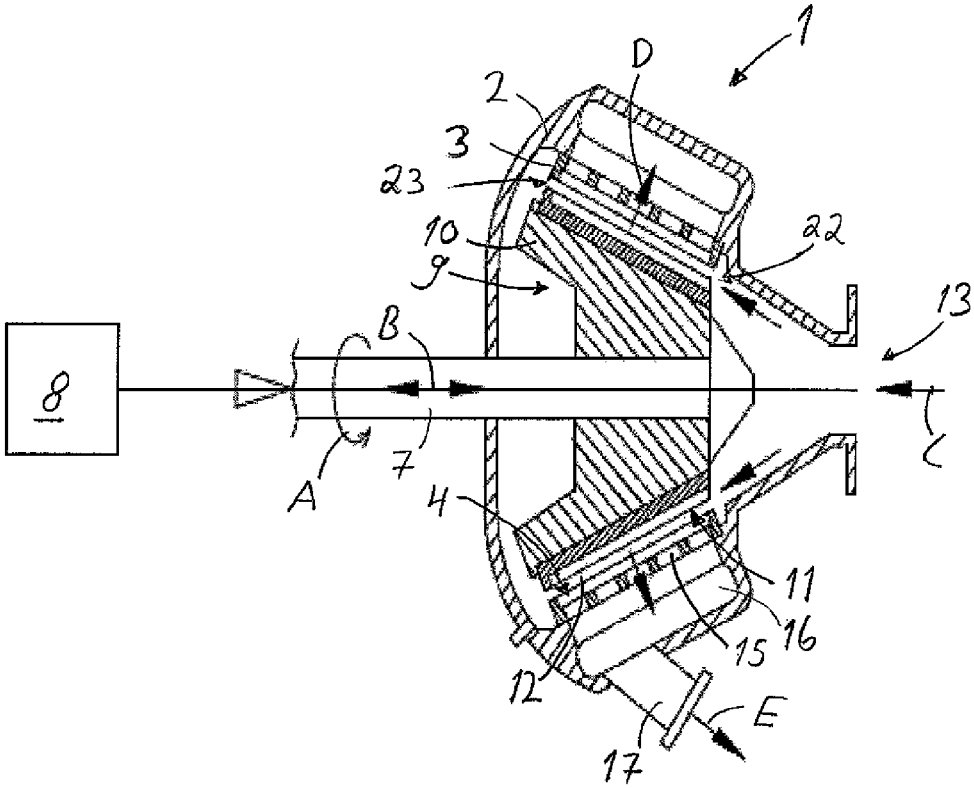
FIG. 11 schematically shows a side view of a fifth cone refiner in cross-section.

FIG. 11 schematically shows a side view of a fifth cone refiner 1 in cross-section. The structure and operation of the cone refiner according to FIG. 11 are similar to those of the cone refiner of FIG. 5, yet with the exception that in the cone refiner of FIG. 11 the rotor 9 structure is closed, which means that there is no open space 21 under or behind the refining surface 11 of the rotor 9, and the refining surface 11 of the rotor 9 does not comprise any openings. When the refiner of FIG. 11 is used, the whole of the volume of the fibrous material to be fed into the refiner 1 via the feed opening 13 or the feed channel 13 flows into the refiner chamber 12 via its first edge 22. Material refined in the refiner chamber 12 is removed from the refiner chamber 12 through the openings 15 in the refining surface 4 of the stator 3 into the intermediate space 16, from where it is further removed from the refiner 1 via the discharge channel 17 or the discharge opening. Part of the refined material may exit the refiner 1 from the second edge 23 of the refiner chamber 12.

Figure 12:
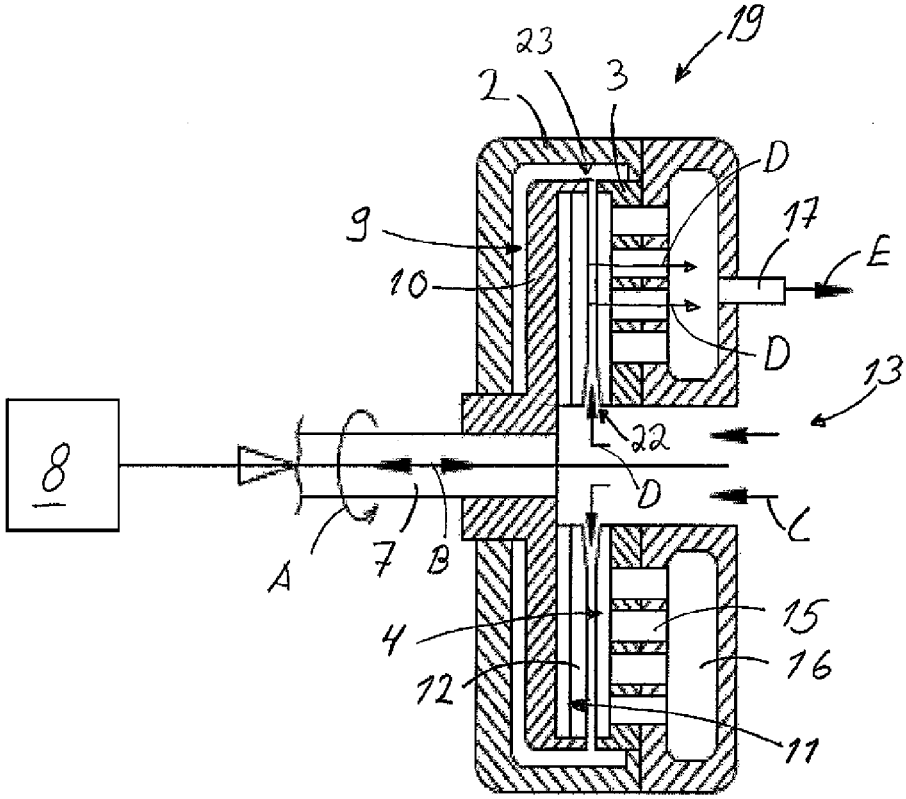
FIG. 12 schematically shows a side view of a third disc refiner in cross-section.

FIG. 12 schematically shows a side view of a third disc refiner 19 in cross-section. The structure and operation of the disc refiner according to FIG. 12 are similar to those of the disc refiner of FIG. 10, yet with the exception that in the disc refiner of FIG. 12 the rotor 9 structure is closed, which means that there is no open space 21 under or behind the refining surface 11 of the rotor 9, and the refining surface 11 of the rotor 9 does not comprise any openings.

When the refiner of FIG. 12 is used, the whole of the volume of the fibrous material to be fed into the refiner 19 via the feed opening 13 or the feed channel 13 flows into the refiner chamber 12 via its first edge 22, because the protective structure 20 is naturally removed in order to allow the feeding of fibrous material. Material refined in the refiner chamber 12 is removed from the refiner chamber 12 through openings 15 in the refining surface 4 of the stator 3 into an intermediate space 16, from where it is further removed from the refiner 1 via a discharge channel 17 or a discharge opening. Part of the refined material may also exit the refiner 1 from the second edge 23 of the refiner chamber 12.

In addition to the examples shown in FIGS. 1 to 12, such a solution is also feasible, in which all fibrous material to be refined is fed into the refiner chamber via the edge of the refiner chamber only, and either the whole or the majority of the refined material exits via the openings in the refining surface of the movable refiner element. In this case, the fixed refiner element or the second movable refining surface opposite to the refining surface of the movable refiner element does not comprise openings, through which material could flow into or exit the refiner chamber.

In the refiner according to the solution, fibrous material to be refined is fed into the refiner chamber at least mainly through the openings in either the refining surface of the movable refiner element or the refining surface of the fixed refiner element, or alternatively the refined fibrous material is removed from the refiner chamber mainly through the openings in either the refining surface of the movable refiner element or the refining surface of the fixed refiner element. However, it is also possible that all the refiner types described above only comprise movable refining surfaces and no fixed refining surfaces at all, in which case the second movable refining surface thus constitutes the second refining surface of the refiner. Thus, the opposite refining surfaces in a disc refiner, for instance, are rotated separately by a shaft in opposite directions.

By feeding fibrous material to be refined through the refining surface, the material to be refined can be fed evenly into the refiner chamber. It is also ensured that the material to be refined flows from the feed of material to its discharge via the refiner chamber, which means that a greater amount of fibers will be refined than before. By removing refined material through the opposite refining surface, it is possible to diminish the flow of the material to be refined and of the refined material in the direction of the refining surface, which reduces pressure losses in the refiner and increases production. By means of the feed rate of material to be refined and the speed of the movable refining surface, it is possible to influence the degree of refining, i.e. how much refining the fibers are subjected to. By feeding material to be refined through either the movable or fixed refining surface and simultaneously removing refined material through the opposite refining surface, the most significant advantages are achieved for the refiner and the entire refining operation.

The solution also allows the flow of material to be defibrated to decrease on the plane of the refining surface or parallel to its tangent, and the design of refining surfaces may thus be mainly focused on optimizing the refining effect directed at fibers, since the significance of the refining surface in the transport of material to be refined and of the refined material is not so great. As a result, transfer of material on the refining surface may be arranged with fewer pressure losses and in more spacious feed and discharge channels of the refiner, thus reducing the power losses of the refiner. If all fibrous material fed into the refiner is to pass through the refining surface into the refiner chamber, cone and cylindrical refiners may, similarly to disc refiners of FIGS. 4 and 10, be provided with different protective structures preventing fibrous material to be fed from flowing directly to the refiner chamber. Accordingly, if all refined material is to be removed from the refiner chamber through the refining surface, different protective structures may be arranged in refiners to prevent the refined material from directly exiting the refiner chamber through its edge.

The openings 15 formed through the refining surface 4 of the stator 3 and the openings 14 formed through the refining surface 11 of the rotor 9 may be formed through the blade bars 5 on the refining surface only, through the blade grooves 6 in the refining surface only, or through both the blade bars 5 and the blade grooves 6 in the refining surface.

Figure 13:
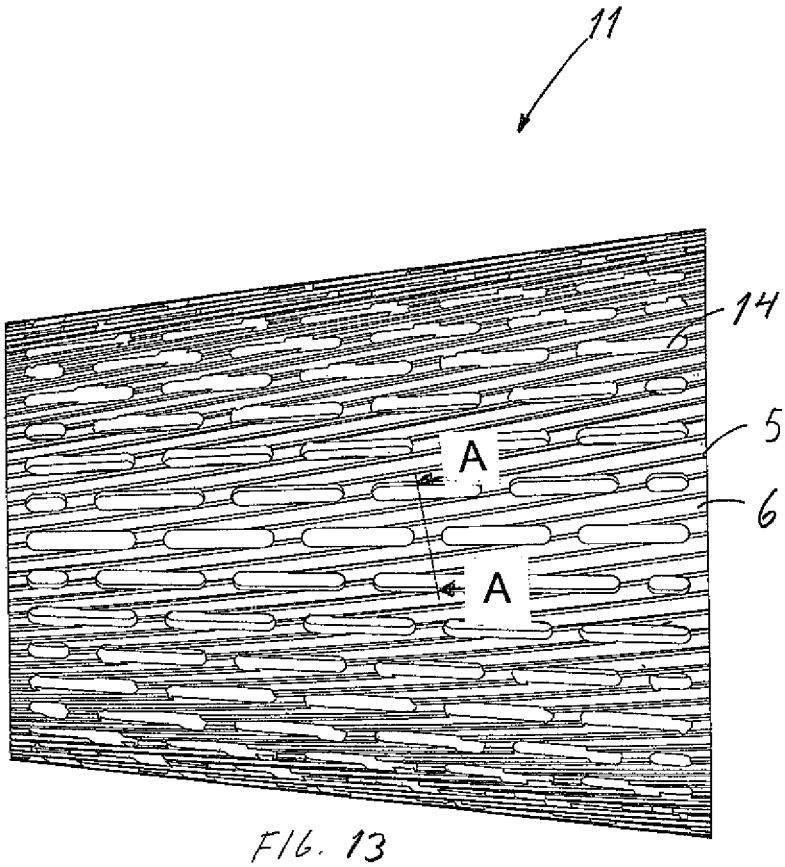
FIG. 13 schematically shows a side view of a second conical refining surface.
Figure 14:
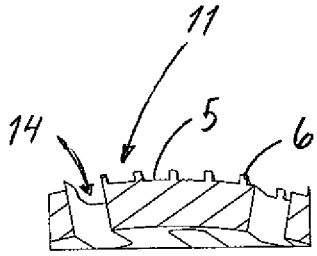
FIG. 14 schematically shows a part of the refining surface of FIG. 13 in cross-section taken along section line A-A.
Figure 15:
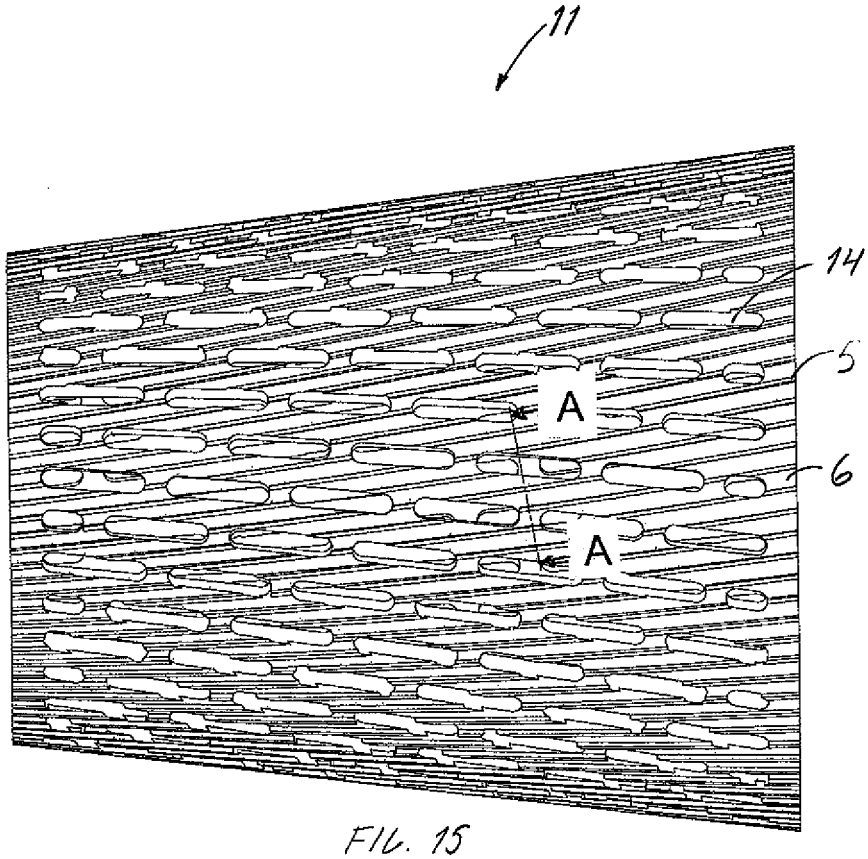
FIG. 15 schematically shows a side view of a third conical refining surface.
Figure 16:
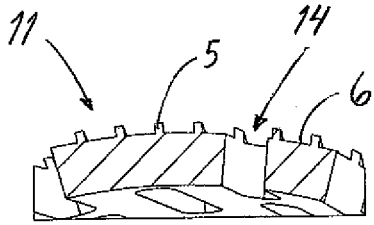
FIG. 16 schematically shows a part of the refining surface of FIG. 15 in cross-section, taken along section line A-A.
Figure 17:
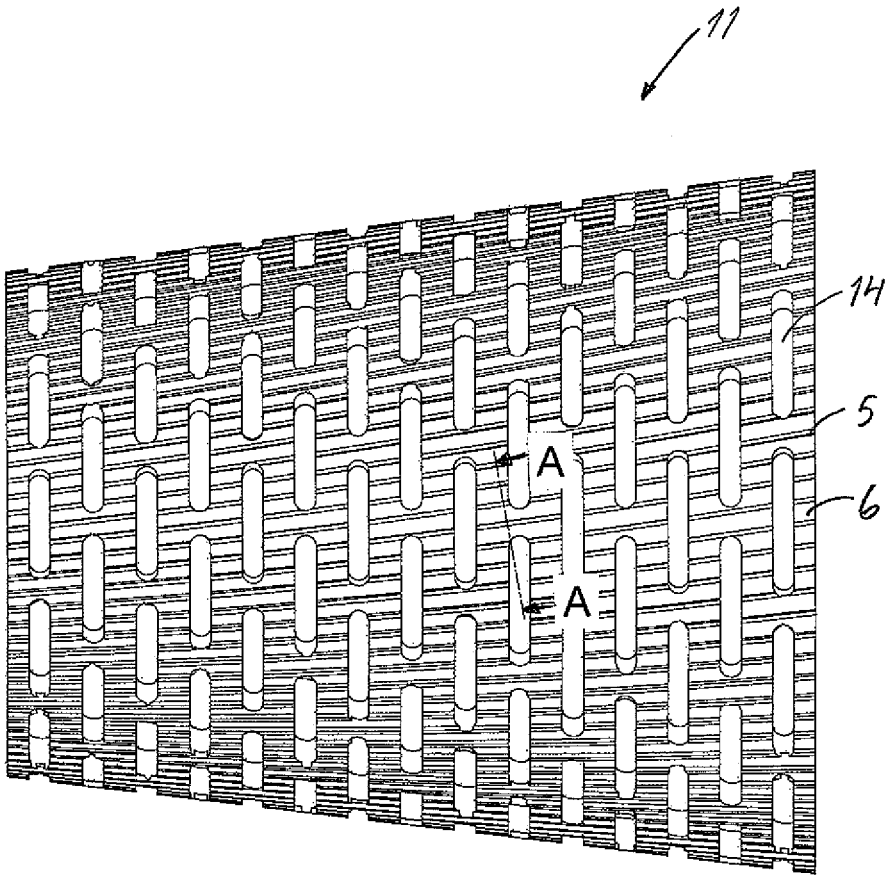
FIG. 17 schematically shows a side view of a fourth conical refining surface.
Figure 18:
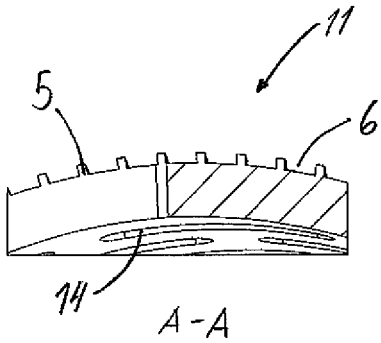
FIG. 18 schematically shows a part of the refining surface of FIG. 17 in cross-section, taken along section line A-A.
Figure 23:
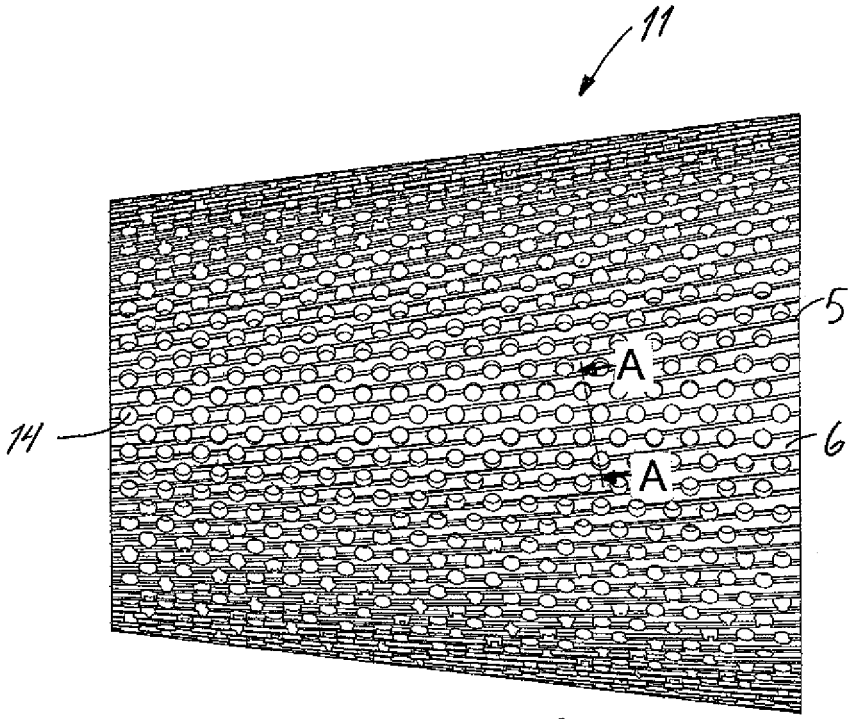
FIG. 23 schematically shows a side view of a sixth conical refining surface.
Figure 24:
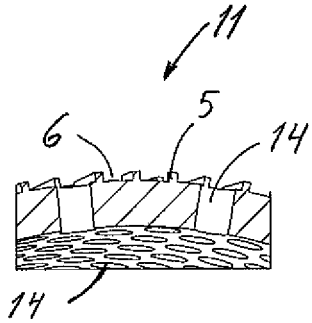
FIG. 24 schematically shows a part of the refining surface of FIG. 23 in cross-section, taken along section line A-A.

The shape, size and direction of the openings 14 and 15 in the refining surfaces as well as the ratio of their surface area to the total area of the refining surface may vary in many different ways. In the embodiment of FIG. 6, the openings 14 are elongated and directed substantially transversally to the direction of travel of the blade bars and blade grooves. However, the openings could also be round or oval or have different polygonal shapes, for example. In addition, their direction of travel may be entirely parallel to the blade bars 5 and the blade grooves 6, transversal to the direction of travel of the blade bars and blade grooves, or in any angular direction between these two directions. The size or surface area of the openings may vary in many different ways, there may be a lot of small openings or fewer bigger openings. The total area of the openings compared to the surface area of the refining surface may also vary in many different ways and ranges preferably from 5 to 70%, more preferably from 7 to 55%, and most preferably from 10 to 40%, for instance from 16 to 17%. All above-mentioned properties of the openings may also differ from one another between the fixed refining surface and the movable refining surface. FIGS. 23 and 24 show a refining surface in which the openings 14 are round. The ratio of the total area of the openings to the surface area of the refining surface is a choice between the efficiency of the feed of material to be refined and/or removal of the refined material and the refining effect to be directed at the material to be refined. The larger the total area of the openings is with respect to the surface area of the refining surface, the more efficiently material to be refined can be fed into the refiner chamber or the refined material can be removed from the refiner chamber. At the same time, however, the surface area of the refining surface contributing to the refining process becomes smaller and the demands on the strength properties of the refining surface material increase. FIGS. 13 to 18 schematically show some conical refining surfaces with elongated openings 14. Elongated openings refer to openings that are considered to have a specific longitudinal direction, i.e. a direction in which the distance between the edges of the opening is greater than the distance between the edges of the opening in the direction substantially transversal to this direction. In the embodiment of FIGS. 13 and 14, the elongated openings extend substantially parallel to the central axis or axis of the refining surface. In the embodiment of FIGS. 15 and 16 the elongated openings extend in a position oblique to the central axis of the refining surface, and in the embodiment of FIGS. 17 and 18 the elongated openings extend substantially transversally to the central axis of the refining surface. In FIGS. 13 to 18, the refining surfaces are depicted as refining surfaces of the refiner's rotor but they might as well be refining surfaces of the refiner's stator.

The elongated openings 14 may thus be arranged substantially parallel to the central axis of the refining surface, as in FIGS. 13 and 14, but by forming elongated openings 14 and arranging the elongated openings on the refining surface at an oblique angle to the axis of the refiner blade, an optimal, large flow area of the openings is achieved in such a manner that the refining area contributing to the refining is large. Elongated openings take up only a small refining area or cover the refining area in a way that does not weaken the efficiency of the refiner. The refiner blade with elongated openings may produce high-quality pulp with a high tensile strength and tear resistance. In addition, an even material flow is achieved throughout the refining area. Also the cross-sectional flow area of a straight flow channel extending through the stator and the rotor, i.e. a channel from where it is possible to see through the stator and rotor blade, is small with respect to the overall flow area of the openings, wherefore the material to be refined undergoes an efficient refining process and cannot significantly pass through the refiner without being refined. Also, the location of the straight flow channel extending through the stator and the rotor changes all the time when the refiner is being used, and thus the entire refining area is utilized for refining. With oblique openings, it is also possible to produce a pumping effect or, alternatively, a retentive effect on the material to be fed into the refiner and/or removed from the refiner, which effect, according to the need, advances or slows down the movement of material in the desired direction. This also allows maintenance of the fluidization of the material to be refined. The elongated openings of the feeding refining surface may be formed in such a manner that the length of an elongated opening comprises at least two blade bars and a o groove therebetween, due to which the pulp to be refined is distributed optimally in the refiner chamber, which results in a controlled, selected and optimal retention in the refiner chamber and the subsequent discharge of the refined material from the blade gap through the openings in the opposite refining surface or the blade surface. This leads to a desired refining process.

When the movable refining surface is arranged as the inner refining surface, which is possible with a cylindrical and cone refiner, a pumping effect is produced in the material flow by centrifugal force, which improves the transfer of the material to be refined into the refiner chamber. The pumping effect may be further increased or decreased by directing the opening or the structure preceding the opening or by utilizing a flow-related design, because the walls of the opening in the movable refining surface that push the material flow cause a force resultant in the material flow, which acts parallel to the normal of the wall. When the movable refining surface is arranged as the outer refining surface, the flow through the opening can be influenced in a corresponding manner by directing the opening. Also in the case of a disc refiner, the flow through the opening in the movable refining surface may also be intensified by means of centrifugal force so that the opening is directed at least to some extent in the direction of the radius. A fixed refining surface does not produce a flow by means of centrifugal force, but the flow through the fixed refining surface can be reduced to a small or large extent by directing the opening by means of forces transmitted to the material flow via the walls of the opening.

Figure 19:
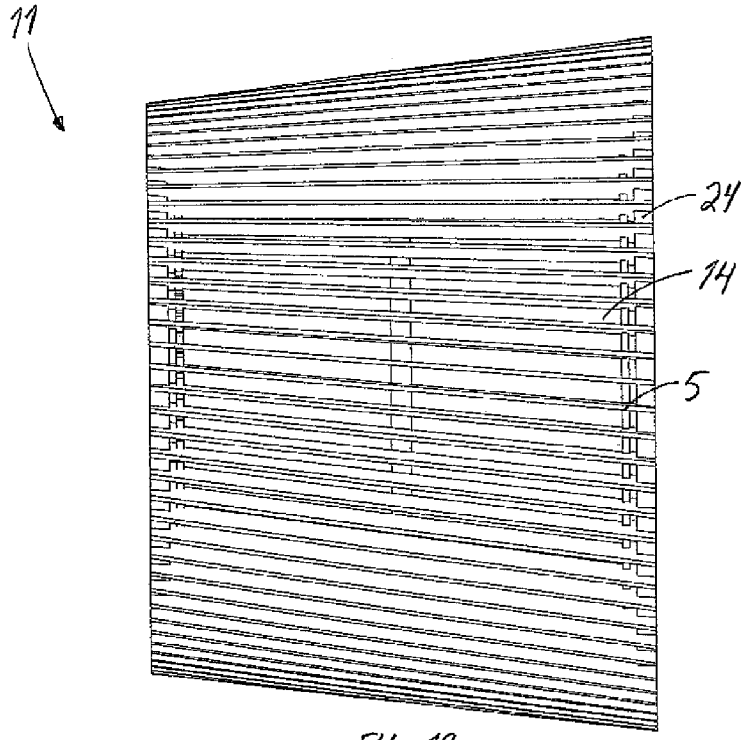
FIG. 19 schematically shows a side view of a fifth conical refining surface.
Figure 20:
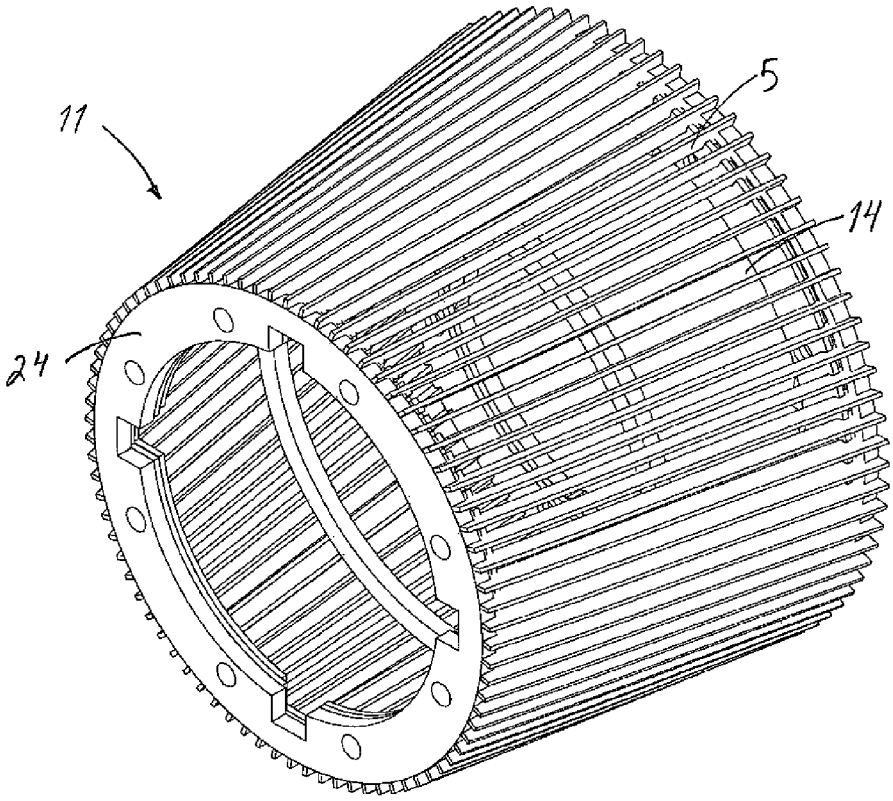
FIG. 20 schematically shows the refining surface of FIG. 19 axonometrically, FIG. 21 schematically shows a side view of a blade segment suitable for a refining surface of a cone refiner from the side.

FIG. 19 schematically shows a side view of a conical refining surface, and FIG. 20 schematically shows the refining surface of FIG. 19 axonometrically. In FIGS. 19 and 20, the refining surface is depicted as a refining surface of the refiner's rotor but it might as well be a refining surface of the refiner's stator. In the embodiment of FIGS. 19 and 20, the refining surface 11 is in a position oblique to the central axis of the refiner and comprises rods or rims at a distance from one another in the circumferential direction of the refining surface and forming the blade bars 5 of the refining surface 11. The blade bars 5 are supported to the support structures 24 or support rings 24 at the ends of the refining surface 11. Elongated openings 14 extending over the entire length of the blade bars 5 are formed between the blade bars 5. It may thus be considered that in the embodiment of FIGS. 19 and 20, the elongated openings 14 extend over the entire length of the grooves between the blade bars in such a manner that the bottom of the grooves is in its entirety covered by the elongated opening 14 extending through the refining surface 11. In this embodiment, openings are densely located, and the material to be refined is efficiently guided directly to each blade bar for refining, whereby the refiner blades are utilized efficiently for refining. In FIGS. 19 and 20, the cross-section of the rods, rims or wires forming the blade bars may be, for instance, rectangular as in the figure, square, triangular or some other cross-sectional shape. Support rings strengthening the structure may be placed in the middle region of the structure in addition to the ends. The structure is attached to the refiner's frame preferably by the support rings at the ends, but may also be attached by the support rings in the middle of the structure, or by using both solutions. The wires are preferably placed at an angle of 0 to 30 degrees to the central axis. The wire width and the distances between the wires may be selected suitably on the basis of the fibrous material to be refined. The openings between the wires may extend in the direction of the radius or be inclined in either direction. In the extreme case, the openings, i.e. the flow channels, may extend over the entire length of the structure.

Figure 21:
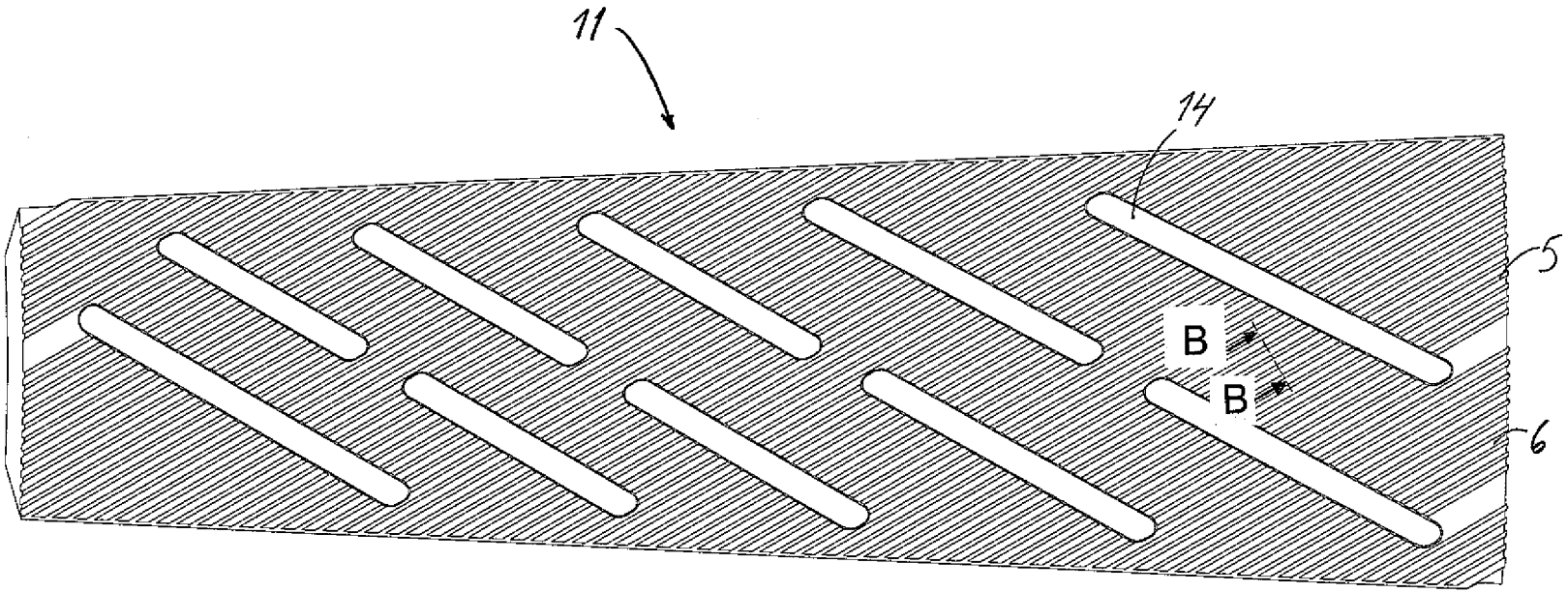
Figure 22:
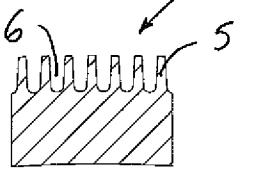
FIG. 22 schematically shows a part of the refining surface of the blade segment of FIG. 21 in cross-section, taken along section line B-B.

FIG. 21 schematically shows a side view of a blade segment suitable for a refining surface of a cone refiner, and FIG. 22 schematically shows a part of the refining surface of the blade segment according to FIG. 21 in cross-section. The blade segment shown in FIGS. 21 and 22 is suitable for constituting a part of the refining surface of the rotor of a conical refiner, for instance. By arranging a suitable number of blade segments of FIG. 21 adjacent to one another, a uniform conical refining surface is achieved. In the embodiment of FIGS. 21 and 22 the openings formed through the refining surface are elongated but could also have another shape, such as a round or oval shape or various polygonal shapes, or they could be implemented in other previously explained manners. Similar blade segments may naturally also be used for forming a refining surface of the stator. Refining surfaces made of blade segments may naturally also be used in cylindrical and disc refiners.

In some cases, the features described in this application may be used as such, regardless of other features. On the other hand, the features described in this application may also be combined to provide various combinations as necessary. The drawings and the related description are only intended to illustrate the idea of the invention. The invention may vary in its details within the scope of the claims. In all embodiments shown in the figures the refining surfaces of the refiners comprise blade bars and blade grooves therebetween for forming a refining surface, but it is naturally obvious that the refining surfaces of a refiner may also be provided in such a manner that, for instance, only one refining surface comprises blade bars and blade grooves therebetween. It is also obvious that, since the refining surface comprises blade bars and blade grooves therebetween, the upper surface of the blade bars, i.e. the surface facing towards the opposite refining surface, may comprise smaller blade bars and blade grooves therebetween. It is also obvious that the first edge of the refiner chamber shown in the figures may, if desired, be defined as the second edge and the second edge may be defined as the first edge. It is also obvious that the blade bars and the blade grooves may be formed in a variety of ways in their longitudinal direction or direction of travel, for example such that the blade bars and the blade grooves therebetween are straight or curved.

The invention claimed is:

1. A refiner for refining fibrous material, the refiner comprising:

at least one refining element forming a shell having a back side, a shell body and a front side, the front side defining a first refining surface comprising portions of the shell body which extend away from the shell body forming outwardly extending blade bars which terminate at the first refining surface, the blade bars defining blade grooves therebetween;

wherein the refining element has portions forming a regular geometrically distributed pattern of a multiplicity of first openings passing though the shell body from the back side to the refiner surface so that at least most of the first openings cut through at least one blade bar, and substantially every blade bar is cut by said openings a plurality of times;

at least one second refining surface which is arranged at least partly substantially opposite to the first refining surface to define a refining area, and a refiner chamber therebetween;

wherein the first refining surface and the second refining surface are arranged to provide for movement between the first refining surface and the second refining surface;

wherein the first refining surface defines a total refining area and wherein the first refining surface first openings are ones through which fibrous material to be refined is arranged to be fed into or removed from the refiner chamber of the refiner, the first openings defining a first opening area; and wherein a ratio is defined between the first opening area composed of said first openings and the total refining area of the first refining surface, which ratio is from 10% to 40%.

2. The refiner of claim 1 wherein the second refining surface defines a second refining area and wherein the second refining surface has second openings formed through the second refining surface through which fibrous material to be refined is arranged to be fed into or removed from the refiner chamber.

3. The refiner of claim 2, wherein the material to be refined is arranged to be fed into the refiner chamber only through the first openings in the first refining surface or only through the second openings in the second refiner surface.

4. The refiner of claim 2, wherein the first openings formed through the first refining surface are arranged only to feed fibrous material into the refiner chamber of the refiner, and wherein the second openings formed through the second refining surface are arranged only to remove fibrous material from the refiner chamber.

5. The refiner of claim 1 wherein one of the first refining surface and the second refining surface is arranged to form a movable refining surface of the refiner, and the other a fixed refining surface of the refiner.

6. The refiner of claim 2, wherein said first openings in the first refiner surface are arranged on the first refiner surface to cover at least 60% of the total area of the first refining surface, and said second openings in the second refiner surface are arranged on the second refiner surface to cover at least 60% of the total area of the second refining surface.

7. The refiner of claim 6, wherein said first openings in the first refiner surface are arranged on the first refiner surface to cover at least 80% of the total area of the first refining surface, and said second openings in the second refiner surface are arranged on the second refiner surface to cover at least 80% of the total area of the second refining surface.

8. The refiner of claim 1 wherein the first openings in the first refining surface have a shape selected from the group consisting of a round, oval, polygonal or elongated shape.

9. The refiner of claim 1 wherein the refiner is selected from the group consisting of: a cone refiner, a cylindrical refiner, and a disc refiner.

10. A method for refining fibrous material comprising the steps of:

refining fibrous material by passing said fibrous material into a refiner chamber formed between a first refining element and a second refining element, the at least one refining element forming a shell having a back side, a shell body and a front side, the front side defining a first refining surface comprising portions of the shell body which extend away from the shell body forming outwardly extending blade bars which terminate at the first refining surface, the blade bars defining blade grooves therebetween, and wherein the refining element has portions forming a regular geometrically distributed pattern of a multiplicity of first openings passing though the shell body from the back side to the first refiner surface so that at least most of the first openings cut through at least one blade bar, and substantially every blade bar is cut by said openings a plurality of times, the second refining element having a second refining surface which is arranged at least partly substantially opposite to the first refining surface;

defibrating the fibrous material in the refiner chamber with the blade bars with the blade grooves therebetween, which blade bars and grooves being formed on at least the first refining surface, the defibrating of the fibrous material in the refiner chamber taking place by moving at least a selected one of the first refining surface and the second refining surface with respect to the other refining surface;

wherein the step of defibrating the fibrous material in the chamber formed between the first refining surface and the second refining surface further comprises passing the fibrous material either in through the first openings or out through the first openings in at least the first refining surface, which first openings extend through the first refining surface into the refiner chamber;

wherein the first refining surface defines a total refining area of the refining surface, and the first openings define a surface area of said first openings; and wherein a ratio is formed between the surface area of said first openings and the total refining area of the first refining surface which is from 10% to 40%.

11. The method of claim 10, wherein fibrous material to be refined is fed through the first openings formed through the first refining surface into the refiner chamber between the refining surfaces and refined fibrous material is removed through second openings formed through the second refining surface from the refiner chamber.

12. The method of claim 10 wherein the material to be refined is fed into the refiner chamber only through the first openings in either the first refining surface or second openings in the second refining surface.

13. The method of claim 10, wherein said first openings through which fibrous material to be refined is fed into the refiner chamber of the refiner are arranged on the first refining surface to cover at least 60% of the total refining area.

14. The method of claim 13, wherein said openings through which fibrous material to be refined is fed into the refiner chamber of the refiner are arranged on the first refining surface to cover at least 80% of the total refining area.

15. The method of claim 10 wherein the second refining surface defines a total refining area and wherein said openings through which fibrous material to be refined is removed from the refiner chamber of the refiner are arranged on the second refining surface to cover at least 60% of the total refining area.

16. The method of claim 15 wherein said openings through which fibrous material to be refined is removed from the refiner chamber of the refiner are arranged on the second refining surface to cover at least 80% of the total refining area.

17. A refiner for refining fibrous material comprising:

at least one refining element forming a shell having a back side, a shell body, and a front side, the front side defining a first refining surface comprising portions of the shell body which extend away from the shell body forming outwardly extending blade bars which terminate at the first refining surface, the blade bars defining blade grooves therebetween;

wherein the at least one refining element has portions forming a regular geometrically distributed pattern of a multiplicity of first openings passing though the shell body from the back side to the first refining surface so that at least most of the first openings cut through at least one bar, and substantially every bar is cut by said openings a plurality of times;

at least one second refining surface which is arranged at least partly substantially opposite to the first refining surface to form a refiner chamber therebetween, to which material to be defibrated is arranged to be fed;

at least a selected one of the first refining surface and the second refining surface in the refiner being arranged to move with respect to the other refining surface;

wherein the first refining surface has a total refining area, and the first refining surface portions forming the first openings are ones through which fibrous material to be refined may be arranged to be fed into the refiner chamber of the refiner or removed from the refiner chamber of the refiner, the first openings defining a surface area; and wherein a ratio is defined of the surface area of said first openings to the total refining area which is from 10% to 40%.

18. The refiner of claim 17 wherein said first openings are arranged on the first refining surface to cover at least 60% of the total refining area.

19. A blade segment for a refiner intended for refining fibrous material, the blade segment comprising a shell having a back side, a shell body, and a front side, the front side defining a first refining surface comprising portions of the shell body which extend away from the shell body forming outwardly extending blade bars which terminate at the first refining surface, the blade bars defining blade grooves therebetween;

wherein the refining surface has portions forming a regular geometrically distributed pattern of a multiplicity of openings passing though the shell body from the back side to the refining surface so that at least most of the openings cut through at least one blade bar, and substantially every blade bar is cut by said openings a plurality of times;

wherein the openings define a surface area of said openings and the refining surface defines a total refining area; and wherein a ratio defined between the surface area of said openings and the total refining area is from 10% to 40%.

* * * * *